US008915786B2

(12) United States Patent
Baerlocher et al.

(10) Patent No.: US 8,915,786 B2
(45) Date of Patent: Dec. 23, 2014

(54) GAMING SYSTEM AND METHOD PROVIDING SIMULTANEOUS GAMING WITH LINKED PAYTABLE EVENTS

(75) Inventors: Anthony J. Baerlocher, Reno, NV (US); Peter Gerrard, Manchester (GB)

(73) Assignee: IGT, Las Vegas, NV (US)

( * ) Notice: Subject to any disclaimer, the term of this patent is extended or adjusted under 35 U.S.C. 154(b) by 1483 days.

(21) Appl. No.: 11/836,376

(22) Filed: Aug. 9, 2007

(65) Prior Publication Data

US 2009/0042652 A1 Feb. 12, 2009

(51) Int. Cl.
*A63F 9/00* (2006.01)
*G07F 17/32* (2006.01)

(52) U.S. Cl.
CPC ..... *G07F 17/3262* (2013.01); *G07F 17/32* (2013.01); *G07F 17/3272* (2013.01); *G07F 17/3258* (2013.01)
USPC ..... 463/42

(58) Field of Classification Search
USPC ..... 463/20, 42
See application file for complete search history.

(56) References Cited

U.S. PATENT DOCUMENTS

| | | | | |
|---|---|---|---|---|
| 4,592,546 | A | | 6/1986 | Fascenda et al. |
| 4,624,459 | A | | 11/1986 | Kaufman |
| 4,669,731 | A | | 6/1987 | Clarke |
| 4,679,143 | A | | 7/1987 | Hagiwara |
| 4,743,022 | A | | 5/1988 | Wood |
| 4,837,728 | A | | 6/1989 | Barrie et al. |
| 4,838,552 | A | | 6/1989 | Hagiwara |
| 4,856,787 | A | * | 8/1989 | Itkis ..... 273/237 |
| 4,869,500 | A | | 9/1989 | Williams |
| 4,890,842 | A | | 1/1990 | Plange |
| 4,991,848 | A | | 2/1991 | Greenwood et al. |
| 5,019,973 | A | | 5/1991 | Wilcox et al. |
| 5,083,785 | A | | 1/1992 | Okada |
| 5,100,137 | A | | 3/1992 | Fulton |
| 5,116,055 | A | | 5/1992 | Tracy |
| 5,123,649 | A | | 6/1992 | Tiberio |
| 5,167,413 | A | | 12/1992 | Fulton |
| 5,224,706 | A | | 7/1993 | Bridgeman et al. |
| 5,248,142 | A | | 9/1993 | Breeding |
| 5,294,120 | A | | 3/1994 | Schultz |
| 5,294,128 | A | | 3/1994 | Marquez |
| 5,342,047 | A | | 8/1994 | Heidel et al. |
| 5,344,144 | A | | 9/1994 | Canon |

(Continued)

FOREIGN PATENT DOCUMENTS

| | | |
|---|---|---|
| AU | 200065501 | 5/2001 |
| EP | 0 945 837 | 9/1999 |

(Continued)

OTHER PUBLICATIONS

Multi-Action Blackjack brochure, http://canjelco.com/faq/bj.html from Apr. 25, 2001, printed on Jul. 30, 2001.

(Continued)

*Primary Examiner* — Seng H Lim
(74) *Attorney, Agent, or Firm* — Neal, Gerber & Eisenberg LLP

(57) ABSTRACT

The gaming device disclosed herein includes a plurality of simultaneously, substantially simultaneously or sequentially played primary games, wherein a designated triggering event in at least one of the games causes the gaming device to change, modify, supplement, add to, activate or otherwise influence the paytable of at least another game.

48 Claims, 29 Drawing Sheets

(56) References Cited

U.S. PATENT DOCUMENTS 5,356,140 A 10/1994 Dabrowski et al.
5,377,973 A 1/1995 Jones et al.
5,380,008 A 1/1995 Mathis et al.
5,393,061 A 2/1995 Manship et al.
5,393,067 A 2/1995 Paulsen et al.
5,401,023 A 3/1995 Wood
5,415,404 A 5/1995 Joshi et al.
5,423,539 A 6/1995 Nagao
5,449,173 A 9/1995 Thomas et al.
5,456,465 A 10/1995 Durham
5,489,101 A 2/1996 Moody
5,511,781 A 4/1996 Wood et al.
5,531,448 A 7/1996 Moody
5,542,669 A 8/1996 Charron et al.
5,570,885 A 11/1996 Ornstein
5,593,161 A 1/1997 Boylan et al.
5,620,182 A 4/1997 Rossides
5,655,961 A 8/1997 Acres et al.
5,657,993 A 8/1997 Merlino et al.
5,695,402 A 12/1997 Stupah
5,707,285 A 1/1998 Place et al.
5,711,715 A 1/1998 Ringo et al.
5,718,431 A 2/1998 Ornstein
5,720,662 A 2/1998 Holmes, Jr. et al.
5,722,890 A 3/1998 Libby et al.
5,732,950 A 3/1998 Moody
5,766,074 A 6/1998 Cannon et al.
5,772,509 A 6/1998 Weiss
5,775,692 A 7/1998 Watts et al.
5,788,573 A 8/1998 Baerlocher et al.
5,788,574 A 8/1998 Ornstein et al.
5,806,855 A 9/1998 Cherry
5,816,916 A 10/1998 Moody
5,820,460 A 10/1998 Fulton
5,823,873 A 10/1998 Moody
5,823,874 A 10/1998 Adams
5,833,538 A 11/1998 Weiss
5,839,730 A 11/1998 Pike
5,851,147 A 12/1998 Stupak et al.
5,868,619 A 2/1999 Wood et al.
5,882,105 A 3/1999 Barlow
5,883,620 A 3/1999 Hobbs et al.
5,902,184 A 5/1999 Bennett
5,910,048 A 6/1999 Feinberg
5,911,418 A 6/1999 Adams
5,933,811 A 8/1999 Angles et al.
5,933,813 A 8/1999 Teicher et al.
5,934,672 A 8/1999 Sines et al.
5,941,772 A 8/1999 Paige
5,946,646 A 8/1999 Schena et al.
5,946,664 A 8/1999 Ebisawa
5,947,820 A 9/1999 Morro et al.
5,954,335 A 9/1999 Moody
5,967,893 A 10/1999 Lawrence et al.
5,976,016 A 11/1999 Moody et al.
5,980,384 A 11/1999 Barrie
5,984,310 A 11/1999 English
5,984,781 A 11/1999 Sunaga
5,997,401 A 12/1999 Crawford
6,004,207 A 12/1999 Wilson, Jr. et al.
6,007,066 A 12/1999 Moody
6,012,720 A 1/2000 Webb
6,012,981 A 1/2000 Fujioka et al.
6,012,983 A 1/2000 Walker et al.
6,015,344 A 1/2000 Kelly et al.
6,024,642 A 2/2000 Stupak
6,039,648 A 3/2000 Guinn et al.
6,053,813 A 4/2000 Mathis
6,062,980 A 5/2000 Luciano
6,062,981 A 5/2000 Luciano, Jr.
6,068,552 A 5/2000 Walker et al.
6,077,163 A 6/2000 Walker et al.
6,093,102 A 7/2000 Bennett
6,098,985 A 8/2000 Moody
6,102,799 A 8/2000 Stupak
6,120,378 A 9/2000 Moody et al.
6,126,541 A 10/2000 Fuchs
6,126,542 A 10/2000 Fier
6,129,632 A 10/2000 Luciano
6,132,311 A 10/2000 Williams
6,142,872 A 11/2000 Walker et al.
6,142,874 A 11/2000 Kodachi et al.
6,149,521 A 11/2000 Sanduski
6,155,925 A 12/2000 Giobbi et al.
6,158,741 A 12/2000 Koelling
6,159,095 A 12/2000 Frohm et al.
6,159,097 A 12/2000 Gura
6,168,520 B1 1/2001 Baerlocher et al.
6,179,711 B1 1/2001 Yoseloff
6,186,894 B1 2/2001 Mayeroff
6,190,255 B1 2/2001 Thomas et al.
6,193,606 B1 2/2001 Walker
6,203,010 B1 3/2001 Jorasch et al.
6,203,429 B1 3/2001 Demar et al.
6,210,277 B1 4/2001 Stefan
6,224,482 B1 5/2001 Bennett
6,224,483 B1 5/2001 Mayeroff
6,224,484 B1 5/2001 Okuda et al.
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,261,178 B1 7/2001 Bennett
6,270,409 B1 8/2001 Shuster
6,290,603 B1 9/2001 Luciano, Jr.
6,299,165 B1 10/2001 Nagano
6,302,791 B1 10/2001 Frohm et al.
6,309,299 B1 10/2001 Weiss
6,312,331 B1 11/2001 Tamaki
6,312,334 B1 11/2001 Yoseloff
6,319,122 B1 11/2001 Packes, Jr. et al.
6,331,143 B1 * 12/2001 Yoseloff ..... 463/18
6,334,613 B1 1/2002 Yoseloff
6,358,147 B1 3/2002 Jaffe et al.
6,375,570 B1 4/2002 Poole
6,398,218 B1 6/2002 Vancura
6,419,578 B1 7/2002 Moody et al.
6,425,823 B1 7/2002 Byrne
6,428,412 B1 8/2002 Anderson et al.
6,435,511 B1 8/2002 Vancura et al.
6,435,968 B1 8/2002 Torango
6,439,995 B1 8/2002 Hughs-Baird et al.
6,443,452 B1 9/2002 Brune
6,443,456 B1 9/2002 Gajor
6,468,156 B1 10/2002 Hughs-Baird et al.
6,471,208 B2 10/2002 Yoseloff et al.
6,517,073 B1 2/2003 Vancura
6,520,856 B1 2/2003 Walker et al.
6,547,663 B1 4/2003 Delott et al.
6,554,283 B2 4/2003 Vancura et al.
6,565,436 B1 5/2003 Baerlocher
6,569,013 B1 5/2003 Taylor
6,589,115 B2 7/2003 Walker et al.
6,599,193 B2 7/2003 Baerlocher et al.
6,607,195 B2 8/2003 Vancura
6,612,927 B1 9/2003 Slomiany et al.
6,634,942 B2 10/2003 Walker et al.
6,652,378 B2 11/2003 Cannon et al.
6,656,040 B1 * 12/2003 Brosnan et al. ..... 463/16
6,702,289 B1 3/2004 Feola
6,702,675 B2 3/2004 Poole et al.
6,712,693 B1 3/2004 Hetlinger
6,712,695 B2 3/2004 Mothwurf et al.
6,726,563 B1 4/2004 Baerlocher et al.
6,739,970 B2 5/2004 Luciano
6,746,016 B2 6/2004 Perrie et al.
6,749,504 B2 6/2004 Hughs-Baird
6,755,738 B2 6/2004 Glasson et al.
6,758,167 B1 7/2004 Edelinski
6,758,749 B2 7/2004 Krintzman
6,764,396 B2 7/2004 Seelig et al.
6,769,982 B1 * 8/2004 Brosnan ..... 463/16
6,786,824 B2 9/2004 Cannon

(56) References Cited

U.S. PATENT DOCUMENTS

| | | | | |
|---|---|---|---|---|
| 6,826,607 | B1 | 11/2004 | Gelvin et al. | |
| 6,832,957 | B2 * | 12/2004 | Falconer | 463/20 |
| 6,834,856 | B2 | 12/2004 | Wilson | |
| 6,857,957 | B2 | 2/2005 | Marks et al. | |
| 6,860,810 | B2 * | 3/2005 | Cannon et al. | 463/20 |
| 6,884,167 | B2 | 4/2005 | Walker et al. | |
| 6,887,157 | B2 * | 5/2005 | LeMay et al. | 463/32 |
| 6,926,607 | B2 | 8/2005 | Slomiany et al. | |
| 6,960,133 | B1 | 11/2005 | Marks et al. | |
| 6,966,836 | B1 | 11/2005 | Rush et al. | |
| 7,001,274 | B2 | 2/2006 | Baerlocher et al. | |
| 7,008,319 | B2 | 3/2006 | Montgomery et al. | |
| 7,014,560 | B2 | 3/2006 | Glavich et al. | |
| 7,029,395 | B1 | 4/2006 | Baerlocher | |
| 7,052,392 | B2 | 5/2006 | Tessmer et al. | |
| 7,052,395 | B2 | 5/2006 | Glavich et al. | |
| 7,056,208 | B2 | 6/2006 | Cogert | |
| 7,076,445 | B1 | 7/2006 | Cartwright | |
| 7,094,149 | B2 | 8/2006 | Walker et al. | |
| 7,121,943 | B2 | 10/2006 | Webb et al. | |
| 7,198,569 | B2 | 4/2007 | Wolf et al. | |
| 7,329,179 | B2 | 2/2008 | Baerlocher | |
| 7,419,429 | B2 | 9/2008 | Taylor | |
| 7,988,549 | B2 * | 8/2011 | Little | 463/20 |
| 8,157,633 | B2 * | 4/2012 | Kaminkow | 463/16 |
| 2001/0038178 | A1 | 11/2001 | Vancura | |
| 2001/0054794 | A1 | 12/2001 | Cole et al. | |
| 2002/0086725 | A1 | 7/2002 | Fasbender et al. | |
| 2002/0137559 | A1 | 9/2002 | Baerlocher | |
| 2002/0187827 | A1 | 12/2002 | Blankstein | |
| 2002/0193158 | A1 | 12/2002 | Weiss et al. | |
| 2002/0198044 | A1 | 12/2002 | Walker et al. | |
| 2003/0003988 | A1 | 1/2003 | Walker et al. | |
| 2003/0027619 | A1 | 2/2003 | Nicastro | |
| 2003/0027626 | A1 * | 2/2003 | Marks et al. | 463/20 |
| 2003/0032479 | A1 * | 2/2003 | LeMay et al. | 463/32 |
| 2003/0060266 | A1 | 3/2003 | Baerlocher | |
| 2003/0060281 | A1 | 3/2003 | Vancura | |
| 2003/0069063 | A1 | 4/2003 | Bilyeu et al. | |
| 2003/0078103 | A1 | 4/2003 | LeMay et al. | |
| 2003/0092480 | A1 | 5/2003 | White et al. | |
| 2003/0092490 | A1 | 5/2003 | Gauselmann | |
| 2003/0119579 | A1 | 6/2003 | Walker et al. | |
| 2003/0144052 | A1 | 7/2003 | Walker et al. | |
| 2003/0148812 | A1 | 8/2003 | Paulsen et al. | |
| 2003/0153383 | A1 | 8/2003 | Baerlocher et al. | |
| 2003/0186745 | A1 | 10/2003 | Nguyen et al. | |
| 2003/0195031 | A1 | 10/2003 | O'Donovan et al. | |
| 2003/0207713 | A1 | 11/2003 | Taylor | |
| 2003/0211879 | A1 * | 11/2003 | Englman | 463/20 |
| 2003/0216165 | A1 | 11/2003 | Singer et al. | |
| 2004/0002385 | A1 | 1/2004 | Nguyen | |
| 2004/0017043 | A1 | 1/2004 | Moody | |
| 2004/0023713 | A1 | 2/2004 | Wolf et al. | |
| 2004/0038724 | A1 | 2/2004 | Asdale | |
| 2004/0043815 | A1 * | 3/2004 | Kaminkow | 463/25 |
| 2004/0048650 | A1 | 3/2004 | Mierau et al. | |
| 2004/0053668 | A1 * | 3/2004 | Baerlocher | 463/18 |
| 2004/0053679 | A1 * | 3/2004 | Getz et al. | 463/20 |
| 2004/0162129 | A1 | 8/2004 | Nelson | |
| 2004/0219969 | A1 | 11/2004 | Casey et al. | |
| 2004/0242307 | A1 | 12/2004 | Laakso et al. | |
| 2004/0242313 | A1 | 12/2004 | Munoz | |
| 2004/0242315 | A1 | 12/2004 | Paulsen et al. | |
| 2004/0254011 | A1 | 12/2004 | Muskin | |
| 2005/0009597 | A1 | 1/2005 | Daly | |
| 2005/0029745 | A1 | 2/2005 | Walker et al. | |
| 2005/0037838 | A1 | 2/2005 | Dunaevsky et al. | |
| 2005/0054429 | A1 | 3/2005 | Baerlocher et al. | |
| 2005/0059481 | A1 | 3/2005 | Joshi et al. | |
| 2005/0059494 | A1 | 3/2005 | Kammler | |
| 2005/0060050 | A1 | 3/2005 | Baerlocher | |
| 2005/0071023 | A1 | 3/2005 | Gilliland et al. | |
| 2005/0079911 | A1 | 4/2005 | Nakatsu | |
| 2005/0096123 | A1 | 5/2005 | Cregan et al. | |
| 2005/0130737 | A1 | 6/2005 | Englman et al. | |
| 2005/0143158 | A1 * | 6/2005 | Odom et al. | 463/13 |
| 2005/0173863 | A1 * | 8/2005 | Walker et al. | 273/292 |
| 2005/0176494 | A1 | 8/2005 | Thomas | |
| 2005/0208992 | A1 | 9/2005 | Randall | |
| 2005/0215311 | A1 | 9/2005 | Hornik et al. | |
| 2005/0218590 | A1 | 10/2005 | O'Halloran et al. | |
| 2005/0233794 | A1 | 10/2005 | Cannon et al. | |
| 2005/0233803 | A1 | 10/2005 | Yang | |
| 2005/0282615 | A1 | 12/2005 | Englman et al. | |
| 2005/0282625 | A1 | 12/2005 | Nicely | |
| 2005/0285337 | A1 | 12/2005 | Durham et al. | |
| 2006/0003834 | A1 | 1/2006 | Okada | |
| 2006/0009283 | A1 | 1/2006 | Englman et al. | |
| 2006/0025193 | A1 | 2/2006 | Gail et al. | |
| 2006/0025211 | A1 | 2/2006 | Wilday et al. | |
| 2006/0040728 | A1 | 2/2006 | Fuller | |
| 2006/0048616 | A1 | 3/2006 | Grenier et al. | |
| 2006/0063580 | A1 | 3/2006 | Nguyen et al. | |
| 2006/0069619 | A1 | 3/2006 | Walker et al. | |
| 2006/0073873 | A1 | 4/2006 | Rodgers et al. | |
| 2006/0073897 | A1 | 4/2006 | Englman et al. | |
| 2006/0094495 | A1 | 5/2006 | Gelber et al. | |
| 2006/0148547 | A1 | 7/2006 | Montgomery et al. | |
| 2006/0160614 | A1 * | 7/2006 | Walker et al. | 463/29 |
| 2006/0217178 | A1 * | 9/2006 | Walker et al. | 463/16 |
| 2006/0252515 | A1 | 11/2006 | Walker et al. | |
| 2006/0287034 | A1 | 12/2006 | Englman et al. | |
| 2007/0021182 | A1 | 1/2007 | Gauselmann | |
| 2007/0032286 | A1 * | 2/2007 | Muir | 463/16 |
| 2007/0060292 | A1 | 3/2007 | Peterson | |
| 2007/0087804 | A1 | 4/2007 | Knowles et al. | |
| 2007/0135207 | A1 | 6/2007 | Tarantino | |
| 2007/0287532 | A1 | 12/2007 | Jackson | |
| 2007/0298860 | A1 * | 12/2007 | Graves et al. | 463/20 |
| 2008/0026816 | A1 * | 1/2008 | Sammon et al. | 463/20 |
| 2008/0076503 | A1 | 3/2008 | Mattie et al. | |
| 2008/0076521 | A1 * | 3/2008 | Little | 463/20 |
| 2008/0076576 | A1 * | 3/2008 | Graham et al. | 463/42 |
| 2008/0171585 | A1 * | 7/2008 | Jackson | 463/16 |
| 2008/0214292 | A1 | 9/2008 | Bryant et al. | |
| 2009/0117999 | A1 * | 5/2009 | Johnson et al. | 463/26 |

FOREIGN PATENT DOCUMENTS

| | | |
|---|---|---|
| EP | 1 076 321 | 2/2001 |
| EP | 1 580 701 | 3/2005 |
| EP | 1 513 114 | 6/2005 |
| WO | WO 85/00910 | 2/1985 |
| WO | WO 01/76709 | 10/2001 |
| WO | WO 02/078804 | 10/2002 |
| WO | 2006002241 | 1/2006 |
| WO | 2006004831 | 1/2006 |
| WO | WO 2006/023907 | 3/2006 |
| WO | 2007090270 | 8/2007 |
| WO | 2005010831 | 10/2009 |

OTHER PUBLICATIONS

Multi-Play Poker by Bally Gaming, printed from ballygaming.com/products/multi-play-poker.html on Apr. 25, 2001.
Multi-Player Poker by Bally Gaming, described in Strictly Slots, published in Dec. 2000.
Play It Again Poker Brochure, written by IGT, published in 1999.
Totem Pole Advertisement, written by IGT, published in 1997.

* cited by examiner

FIG. 5A

GAME 1 60

PAYTABLE

| OUTCOME | AWARD |
|---|---|
| 7 7 7 | 10 |
| ♡ ♡ ♡ | 10 |
| 🍒 🍒 🍒 | 10 |

80

GAME 2 62

PAYTABLE

| OUTCOME | AWARD |
|---|---|
| 7 7 7 | 10 |
| ♡ ♡ ♡ | 10 |
| 🍒 🍒 🍒 | 10 |

82

GAME 3 64

PAYTABLE

| OUTCOME | AWARD |
|---|---|
| 7 7 7 | 10 |
| ♡ ♡ ♡ | 10 |
| 🍒 🍒 🍒 | 10 |

84

FIG. 5D

GAME 1

PAYTABLE

| OUTCOME | AWARD |
|---|---|
| 7 7 7 | 10 |
| ♡ ♡ ♡ | 10 |
| 🍒 🍒 🍒 | 10 |

80

GAME 2

PAYTABLE

| OUTCOME | AWARD |
|---|---|
| 7 7 7 | 10 |
| ♡ ♡ ♡ | 10 |
| 🍒 🍒 🍒 | 10 |

82

GAME 3

PAYTABLE

| OUTCOME | AWARD |
|---|---|
| 7 7 7 | 10 X 2 = 20 |
| ♡ ♡ ♡ | 10 X 2 = 20 |
| 🍒 🍒 🍒 | 10 X 2 = 20 |

84

PLAYER RECEIVES 200 CREDITS FOR GAME 2. CONGRATULATIONS. BECAUSE GAMES TWO WAS THE WINNER, GAME 3 AWARD IS MULTIPLIED BY TWO, MAKING GAME 3 AWARD 400 CREDITS AND TOTAL AWARD 600 CREDITS.

FIG. 7A

GAME 1

PAYTABLE

| OUTCOME | AWARD |
|---|---|
| 7 7 7 | 10 |
| ♡ ♡ ♡ | 10 |
| 🍒 🍒 🍒 | 10 |
| BONUS GAME | |
| 7 7 7 | 20 |
| ♡ ♡ ♡ | 20 |
| 🍒 🍒 🍒 | 20 |

80

GAME 2

PAYTABLE

| OUTCOME | AWARD |
|---|---|
| 7 7 7 | 10 |
| ♡ ♡ ♡ | 10 |
| 🍒 🍒 🍒 | 10 |
| BONUS GAME | |
| 7 7 7 | 20 |
| ♡ ♡ ♡ | 20 |
| 🍒 🍒 🍒 | 20 |

82

GAME 3

PAYTABLE

| OUTCOME | AWARD |
|---|---|
| 7 7 7 | 10 |
| ♡ ♡ ♡ | 10 |
| 🍒 🍒 🍒 | 10 |
| BONUS GAME | |
| 7 7 7 | 20 |
| ♡ ♡ ♡ | 20 |
| 🍒 🍒 🍒 | 20 |

84

FIG. 7E

GAME 1

PAYTABLE

| OUTCOME | AWARD |
|---|---|
| 7 7 7 | 10 |
| ♡ ♡ ♡ | 10 |
| 🍒 🍒 🍒 | 10 |
| **BONUS GAME** | |
| 7 7 7 | 20 X 2 = 40 |
| ♡ ♡ ♡ | 20 X 2 = 40 |
| 🍒 🍒 🍒 | 20 X 2 = 40 |

80

GAME 2

PAYTABLE

| OUTCOME | AWARD |
|---|---|
| 7 7 7 | 10 |
| ♡ ♡ ♡ | 10 |
| 🍒 🍒 🍒 | 10 |
| **BONUS GAME** | |
| 7 7 7 | 20 X 2 = 40 |
| ♡ ♡ ♡ | 20 X 2 = 40 |
| 🍒 🍒 🍒 | 20 X 2 = 40 |

82

GAME 3

PAYTABLE

| OUTCOME | AWARD |
|---|---|
| 7 7 7 | 10 |
| ♡ ♡ ♡ | 10 |
| 🍒 🍒 🍒 | 10 |
| **BONUS GAME** | |
| 7 7 7 | 20 X 2 = 40 |
| ♡ ♡ ♡ | 20 X 2 = 40 |
| 🍒 🍒 🍒 | 20 X 2 = 40 |

84

FIG. 11A

GAME 1 (60)

| PAYTABLE (80) | | ALTERNATIVE 1 (80a) | | ALTERNATIVE 2 (80b) | |
|---|---|---|---|---|---|
| OUTCOME | AWARD | OUTCOME | AWARD | OUTCOME | AWARD |
| ♡♡♡ | 10 | ♡♡♡ | 20 | ♡♡♡ | 30 |
| 7 7 7 | 10 | 7 7 7 | 20 | 7 7 7 | 30 |
| 🍒🍒🍒 | 10 | 🍒🍒🍒 | 20 | 🍒🍒🍒 | 30 |

GAME 2 (62)

| PAYTABLE (82) | | ALTERNATIVE 1 (82a) | | ALTERNATIVE 2 (82b) | |
|---|---|---|---|---|---|
| OUTCOME | AWARD | OUTCOME | AWARD | OUTCOME | AWARD |
| ♡♡♡ | 10 | ♡♡♡ | 20 | ♡♡♡ | 30 |
| 7 7 7 | 10 | 7 7 7 | 20 | 7 7 7 | 30 |
| 🍒🍒🍒 | 10 | 🍒🍒🍒 | 20 | 🍒🍒🍒 | 30 |

GAME 3 (64)

| PAYTABLE (84) | | ALTERNATIVE 1 (84a) | | ALTERNATIVE 2 (84b) | |
|---|---|---|---|---|---|
| OUTCOME | AWARD | OUTCOME | AWARD | OUTCOME | AWARD |
| ♡♡♡ | 10 | ♡♡♡ | 20 | ♡♡♡ | 30 |
| 7 7 7 | 10 | 7 7 7 | 20 | 7 7 7 | 30 |
| 🍒🍒🍒 | 10 | 🍒🍒🍒 | 20 | 🍒🍒🍒 | 30 |

GAMING SYSTEM AND METHOD PROVIDING SIMULTANEOUS GAMING WITH LINKED PAYTABLE EVENTS

CROSS REFERENCE TO RELATED APPLICATIONS

This application relates to the following commonly owned co-pending application: "GAMING MACHINES AND SYSTEMS OFFERING SIMULTANEOUS PLAY OF MULTIPLE GAMES AND METHODS OF GAMING," U.S. application Ser. No. 11/069,210.

COPYRIGHT NOTICE

A portion of the disclosure of this patent document contains or may contain material which is subject to copyright protection. The copyright owner has no objection to the photocopy reproduction by anyone of the patent document or the disclosure in exactly the form it appears in the Patent and Trademark Office patent file or records, but otherwise reserves all copyright whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In certain known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from 1 credit up to 125 credits (e.g., 5 credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. Part of the enjoyment and excitement of playing certain gaming machines is the occurrence or triggering of the secondary or bonus game (even before the player knows how much the bonus award will be). In other words, obtaining a bonus event and a bonus award in the bonus event contributes to player enjoyment and excitement.

Other known gaming devices simultaneously display and enable a player to simultaneously wager on two or more primary games. One known gaming device enables a player to choose and play more than one game at a time. However, each of these games is independent of the other games and the outcome of one game does not affect the outcome of another. In another known gaming device, a player wagers on three five card poker hands. A first row of five cards is dealt face up and second and third rows of five cards are dealt face down. The player may hold one or more of the face up cards from the first row. The cards the player holds are duplicated in their corresponding vertical position in the second and third rows. Replacement cards for the non-selected cards in the first row are dealt. The face down cards in each of the second and third hands are turned face up. Each five card hand is evaluated individually for winning poker combinations and the player is provided with an award for any winning poker hands based on a paytable and the amount of the player's wager on each respective poker hand. While these hands are linked by the duplication step, the outcome of one game does not affect the paytable of another game.

A need exists for new and different gaming devices and methods that enable a player to play multiple games.

SUMMARY

Various embodiments of the gaming device and method disclosed herein include a plurality of simultaneously, substantially simultaneously or sequentially played primary games. In various embodiments, each primary game has a default paytable and is operable upon a wager by a player. The player may wager on each of the primary games individually or may wager on two or more of the primary games in one or more groups.

Each paytable includes a plurality of game outcomes including at least one or more different winning game outcomes and one or more different losing game outcomes. These winning game outcomes and losing game outcomes include primary game outcomes and can also include bonus game outcomes for bonus games associated with each respective primary game. Each paytable also includes one or more different awards associated with each of its respective winning game outcomes. In one embodiment disclosed herein, if the player wagers on one or more primary games, the gaming device randomly generates an outcome for each of the wagered on primary games regardless of the outcome of any of the other primary games. In this embodiment, if a designated triggering event occurs in at least one of the games, the gaming device changes, modifies, supplements, adds to or otherwise influences the paytable of at least one of the other primary games used to determine awards for one or more plays of those primary games. In another embodiment, if a designated triggering event occurs in at least one of the games, the gaming device activates at least one paytable in addition to or in substitution of the default paytable for one or more of the games used to determine awards associated with one or more plays of those games.

In various embodiments disclosed herein, the designated triggering event is the occurrence of a predetermined symbol or set of symbols in the outcome of one or more primary games. Alternatively, the designated triggering event may be a game event which may or may not be linked to the occurrence of certain symbols in the outcomes of one or more games. The designated triggering event may also be any suitable combination of symbol occurrences and game events. In one embodiment, the designated triggering event occurs in an apparently random fashion. In one such embodiment, the gaming device does not provide any apparent reasons to the players for the occurrences of changes to the paytable (or other events). In one such embodiment, causing a change to a paytable is not triggered by an event in the primary game or based specifically on any of the plays of any primary game or on any of the plays of any secondary game.

The occurrence of a designated triggering event can cause the gaming device to change, modify, supplement, add to or otherwise influence the paytable of one or more of the primary games in one or more of a plurality of different ways. In various embodiments, an occurrence of a designated triggering event in one of the primary games causes: (a) one of the awards associated with one of the winning outcomes in the paytable to change (such as increase or multiply); (b) a plurality of the awards associated with a plurality of the winning outcomes in the paytable to change (such as increase or multiply); (c) one of the winning outcomes in the paytable to change (such as become easier or harder to generate); (d) a plurality of the winning outcomes in the paytable to change (such as become easier or harder to generate); (e) the addition of a winning outcome (and an associated award) to the paytable; (f) the addition of a plurality of winning outcomes (and associated awards) to the paytable; (g) changes to what bonus games or progressives are available; (h) any combination of these; or (i) any other suitable change. These changes are sometimes referred to herein as "changing a paytable" for brevity.

As an example, in one embodiment, the designated triggering event is the occurrence of one or more designated symbols at a designated payline of a slot-type game. In one such embodiment, the designated triggering event causes the gaming device to modify an award associated with that payline in one or more paytables. It should be appreciated that this type of embodiment extends to any component of a game (i.e., a payline or a segment of a wheel) such that a triggering event associated with a designated component changes at least one award associated with that component in at least one other paytable.

Additionally, the occurrence of a designated triggering event can cause the gaming device to activate a variety of paytables in addition to or in substitution of one or more of the default paytables for determining awards associated with one or more plays of the games. In various embodiments, an occurrence of a designated triggering event in one of the primary games causes: (a) the activation of an alternative paytable for determining awards in one or more plays of one or more of the games; (b) the activation of a supplementary paytable associated with at least one secondary game; (c) any combination of these; or (d) the activation of any other suitable paytable.

It should be appreciated that in the various embodiments disclosed herein, the gaming device or a central controller or server stores the default paytable for or associated with each of the various games. When the gaming device changes the paytable of one or more games or substitutes the paytable of one or more games with an alternative paytable, each paytable is changed or substituted for a designated period such as a finite amount of time. The period one or more paytables are changed or substituted may be: (a) a predetermined amount of time (such as 15 minutes); (b) a randomly determined amount of time; (b) the duration of a certain number of games; (c) the duration of a round of play; (d) the time leading up to the occurrence of a predetermined event; (e) a period based upon the number of credits wagered; or (f) any other suitable period. In the embodiments disclosed herein, the gaming device does not permanently change the stored default version of any paytable.

It should be appreciated that each game may have or be associated with one alternative paytable or multiple alternative paytables. Further, an alternative paytable may be associated with one game or multiple games.

The occurrence of a designated triggering event may cause the paytable of one game to be changed or substituted, or the paytables of multiple games to be changed or substituted. In different embodiments, the manner in which one or more paytables are changed, what alternative paytable is activated or what supplementary paytable is activated depends on at least one of the following: (a) which designated triggering event occurs; (b) how many different games the designated triggering event occurs in; (c) how many times the designated triggering event occurs in a game or series of games; and (d) any other suitable criteria.

It should be appreciated that the primary games may be the same type of game or different types of games. For example, one primary game may be a slot-type game and another primary game may be a video poker game.

By enabling a player to simultaneously, substantially simultaneously or sequentially play a plurality of separately wagered on primary games and enabling a designated triggering event to cause the change or activation of one or more paytables, the gaming device provides a player a greater degree of excitement and enjoyment. Losing combinations in certain games also contribute to wins in other games. Further, by enabling the player to play all games wagered on, regardless of the outcome of other games, the gaming device provides the player with more value, as the player does not lose the opportunity to play certain games if the gaming device generates a losing outcome for another game.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE FIGURES

FIGS. 5A, 5B, 5C, 5D and 5E include front views of a gaming device display enabling the simultaneous, substantially simultaneous or sequential play of three primary games in accordance with one embodiment of the gaming device disclosed herein and illustrations of the paytables associated with those three primary games.

FIGS. 7A, 7B, 7C, 7D, 7E and 7F include front views of a gaming device display enabling the simultaneous, substantially simultaneous or sequential play of three primary games and the paytables associated with those primary games in accordance with one embodiment of the gaming device disclosed herein.

FIGS. 11A, 11B, 11C and 11D include front views of a gaming device display enabling the simultaneous, substantially simultaneous or sequential play of three primary games and the paytables associated with those primary games in accordance with one embodiment of the gaming device disclosed herein.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
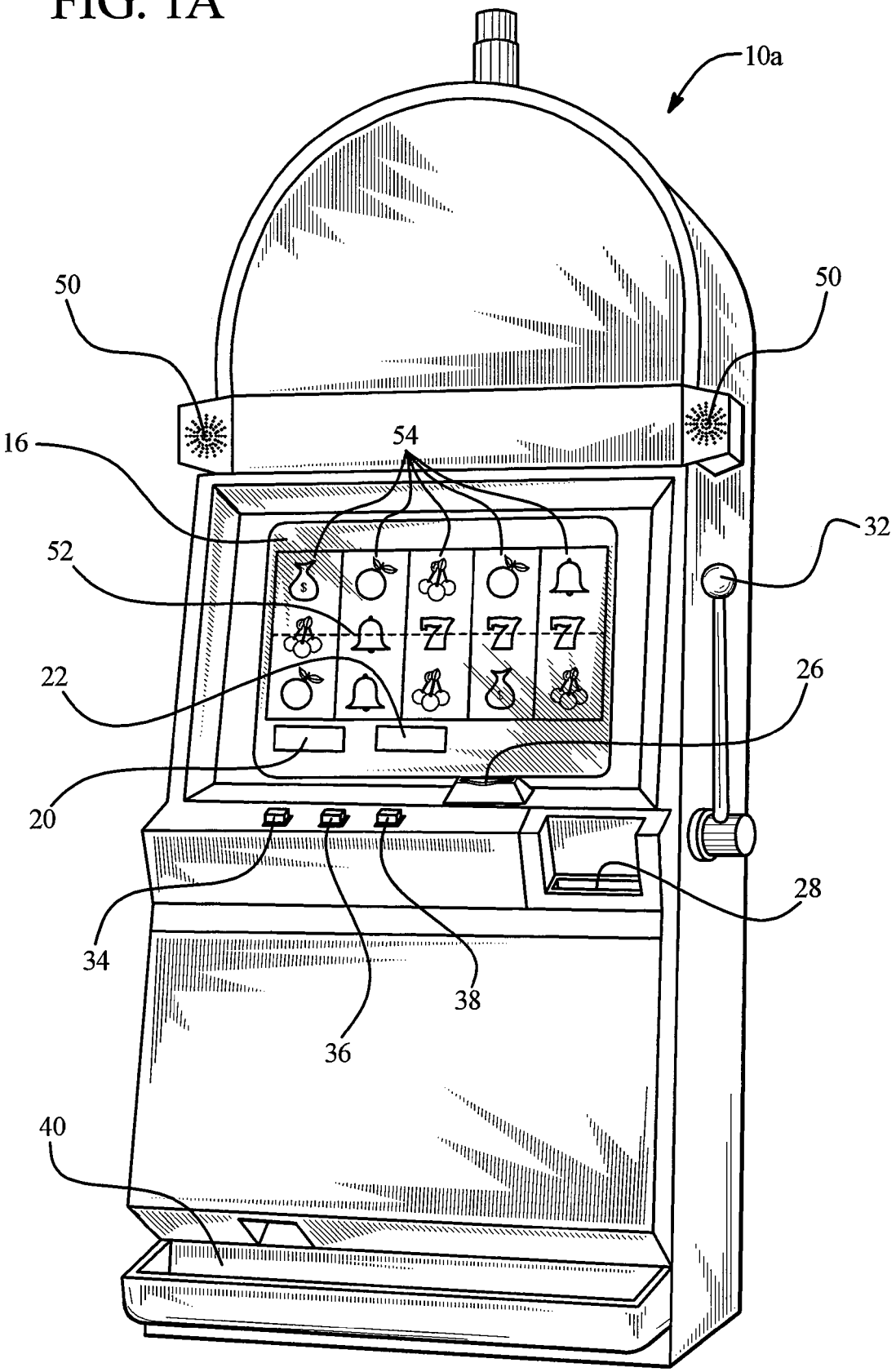
FIGS. 1A and 1B are front perspective views of alternative embodiments of gaming devices disclosed herein.
Figure 1B:
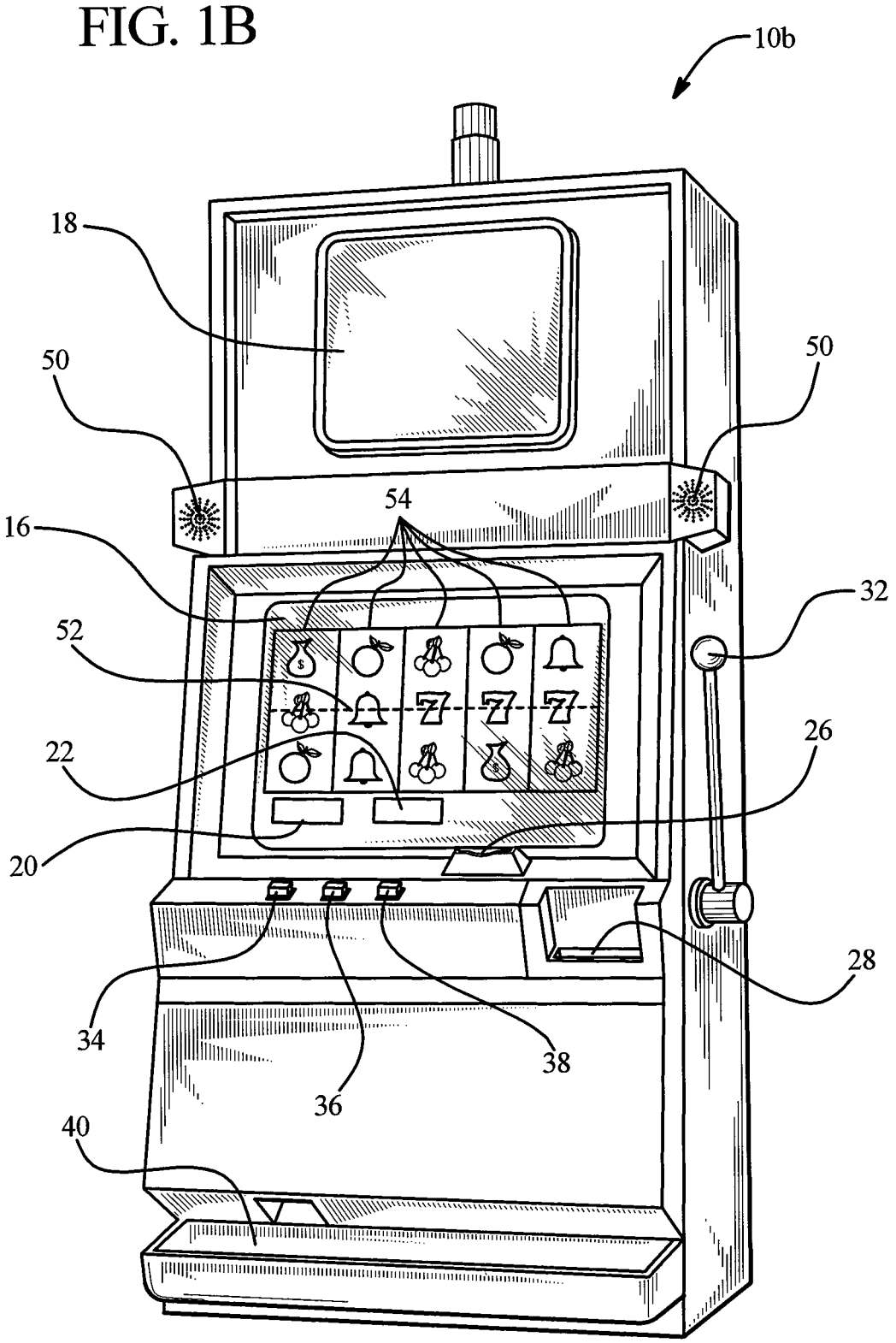

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
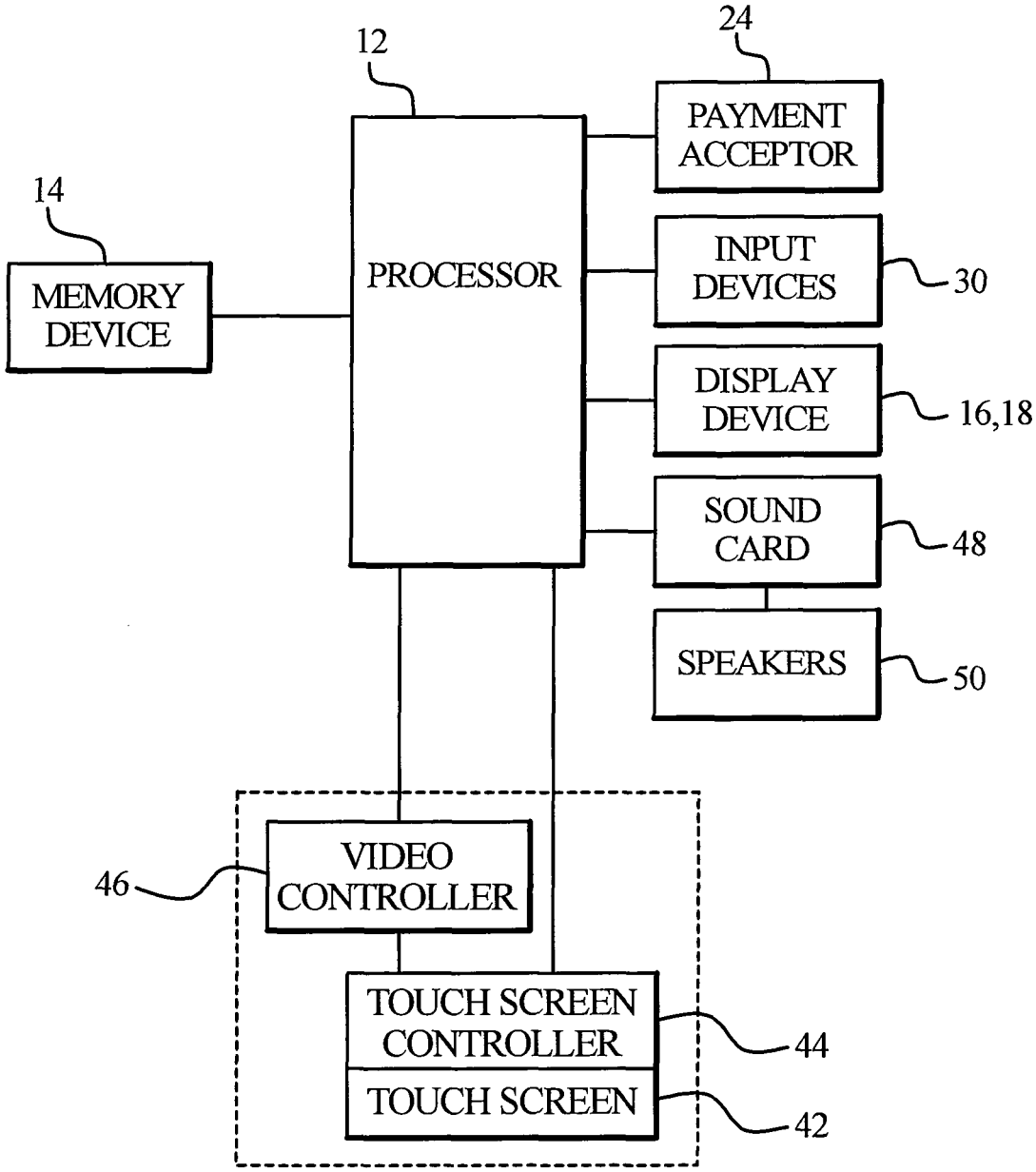
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The display device may also display multiple games simultaneously. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base games. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. In one embodiment, gaming device 10 includes multiple types of primary or base games for simultaneous, substantially simultaneous or sequential play. In another embodiment, the primary game or games played during a play of a game are the same type of game.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game. In another embodiment, the player may simultaneously or substantially simultaneously play multiple bonus games, which may be same type or bonus game or different bonus games.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
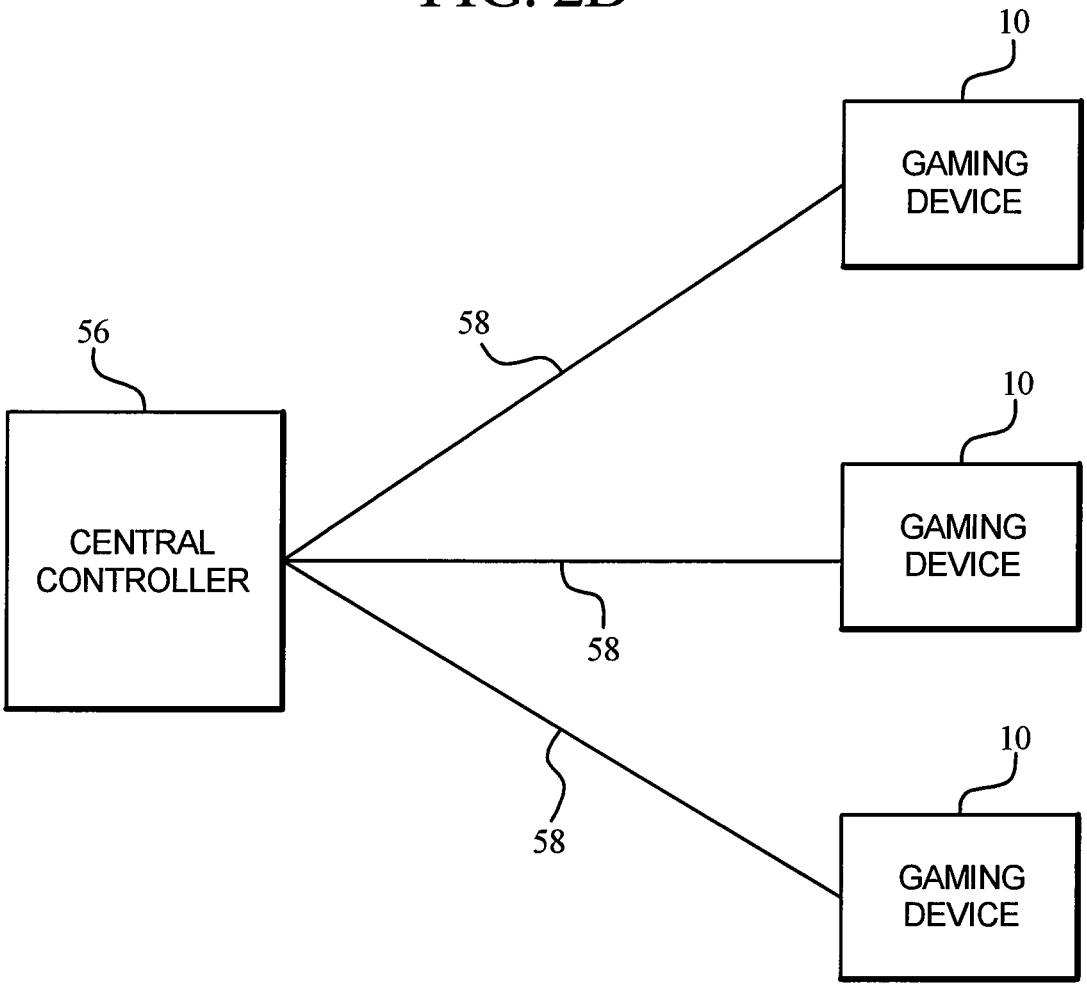
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Simultaneous Games

Various embodiments of the gaming device and method disclosed herein include a plurality of simultaneously, substantially simultaneously or sequentially played primary games.

In one embodiment, the occurrence of a designated triggering event in at least one of a plurality of wagered on games causes the gaming device to modify the paytable for or associated with at least one of the games. It should be appreciated that the gaming device may modify one paytable or may modify multiple paytables.

Figure 3A:
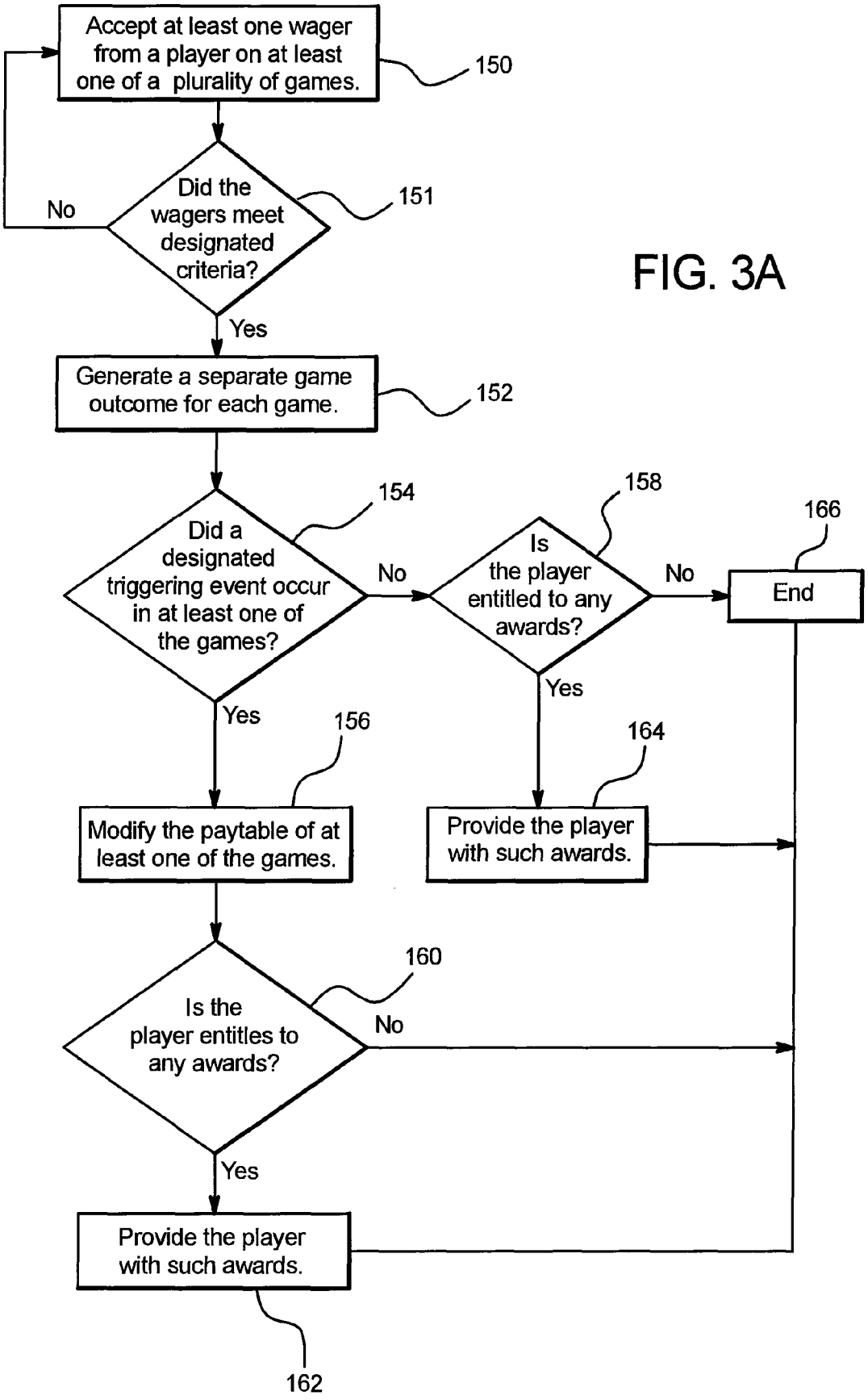
FIGS. 3A and 3B are flowcharts of embodiments of the gaming device and method disclosed herein.

Referring now to the flowchart in FIG. 3A, the gaming device accepts at least one wager from a player on at least one of a plurality of games, as illustrated in block 150. The gaming device determines if the wagers meet a designated criteria, as illustrated in diamond 151. It should be appreciated that in various embodiments, the designated criteria includes: (a) the placement of a minimum bet; (b) the placement of a side bet; (c) the placement of a wager on one or more of a plurality games; (d) the placement of a wager on all of a plurality of games; (e) any combination of these; or (f) any other suitable wager-based based eligibility criteria. The gaming device simultaneously, substantially simultaneously or sequentially generates a separate outcome for each of the wagered on games, as illustrated in block 152 (timing of outcome generation not shown). The gaming device determines if a designated triggering event occurs in at least one of the games, as illustrated in diamond 154. If a designated triggering event does not occur during or result from the plays of the games, a player may still be entitled to awards for one or more winning game outcomes. Thus, if a designated triggering event does not occur, the gaming device determines if the player is entitled to any awards using the default paytable for each of the respective games, as illustrated in diamond 158. If the player is entitled to any awards, the gaming device provides the player with those awards, as illustrated in block 164. If the player is not entitled to any awards, the game ends, as illustrated in block 166.

Still referring to FIG. 3A, if a designated triggering event occurs in at least one of the games, the gaming device modifies the paytable of at least one of the games, as illustrated in block 156. The gaming device then determines if the player is entitled to any awards using the paytables for each of the respective games, as illustrated in diamond 160, at least one of which is modified. If the gaming device determines that the player is not entitled to any awards, the game ends. If the gaming device determines that the player is entitled to any awards, the gaming device provides the player with those awards, as illustrated in block 162. It should be appreciated that modified paytables may include modified awards and unmodified awards.

In another embodiment, when the gaming device modifies the paytable of one or more of the games, each modified paytable is modified for a designated period. Referring now to the flowchart in FIG. 3B, the gaming device accepts at least one wager from a player on at least one of a plurality of games, as illustrated in block 250. The gaming device determines if the wagers meet a designated criteria, as illustrated in diamond 251. The gaming device generates a separate outcome for each game, as illustrated in block 252. The gaming device determines if a designated triggering event occurs in at least one of the games, as illustrated in diamond 254. If a designated triggering event does not occur or result from the plays of the games, similar to the method disclosed in FIG. 3A, the gaming device determines if the player is entitled to any awards using the paytables for each of the respective games, as illustrated in diamond 258. If the player is entitled to any awards, the gaming device provides the player with those awards, as illustrated in block 266. If the gaming device determines that a designated triggering event occurs in at least one of the games, the gaming device modifies the paytable of at least one of the games used for determining awards for one or more plays of those games, as illustrated in block 256.

Figure 3B:
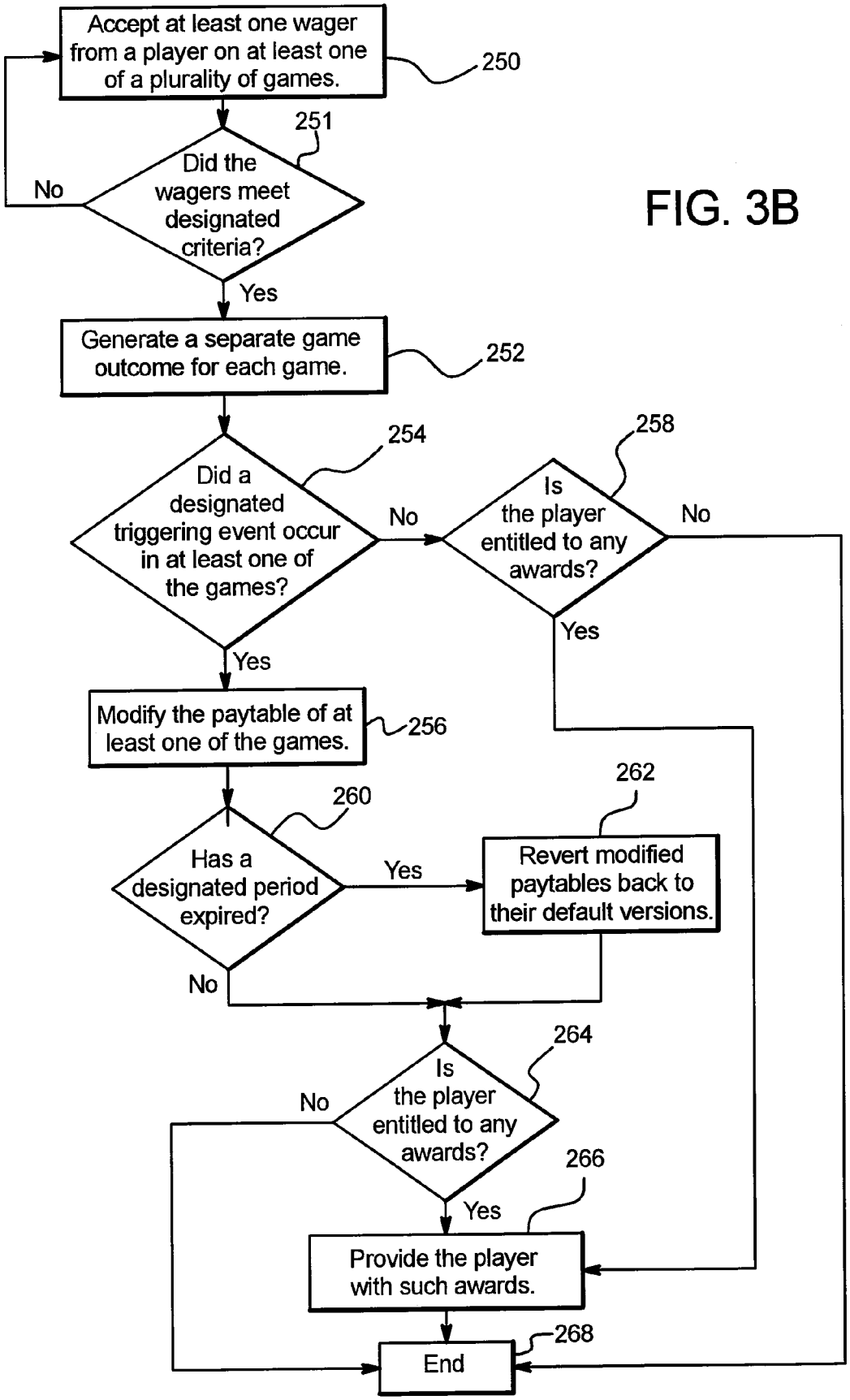

Still referring to FIG. 3B, the gaming device determines if a designated period has expired, as illustrated in diamond 260. If a designated period has expired, the gaming device reverts any paytables modified in block 256 back to their default versions, as illustrated in block 262, and determines if the player is entitled to any awards using the default paytables for each of the games, as illustrated in diamond 264. If a designated period has not expired, the gaming device determines if the player is entitled to any awards using the paytables for each of the games, at least one of which is modified, as illustrated in diamond 264. If the gaming device determines that the player is entitled to any awards, the gaming device provides the player with those awards, as illustrated in block 266. After the gaming device provides the player with those awards, the game ends, as illustrated in block 268.

In another embodiment, the occurrence of a designated triggering event in at least one of a plurality of wagered on games causes the gaming device to activate an alternative paytable for or associated with at least one of the games. It should be appreciated that the gaming device may activate an alternative paytable for one game or multiple games.

Figure 4:
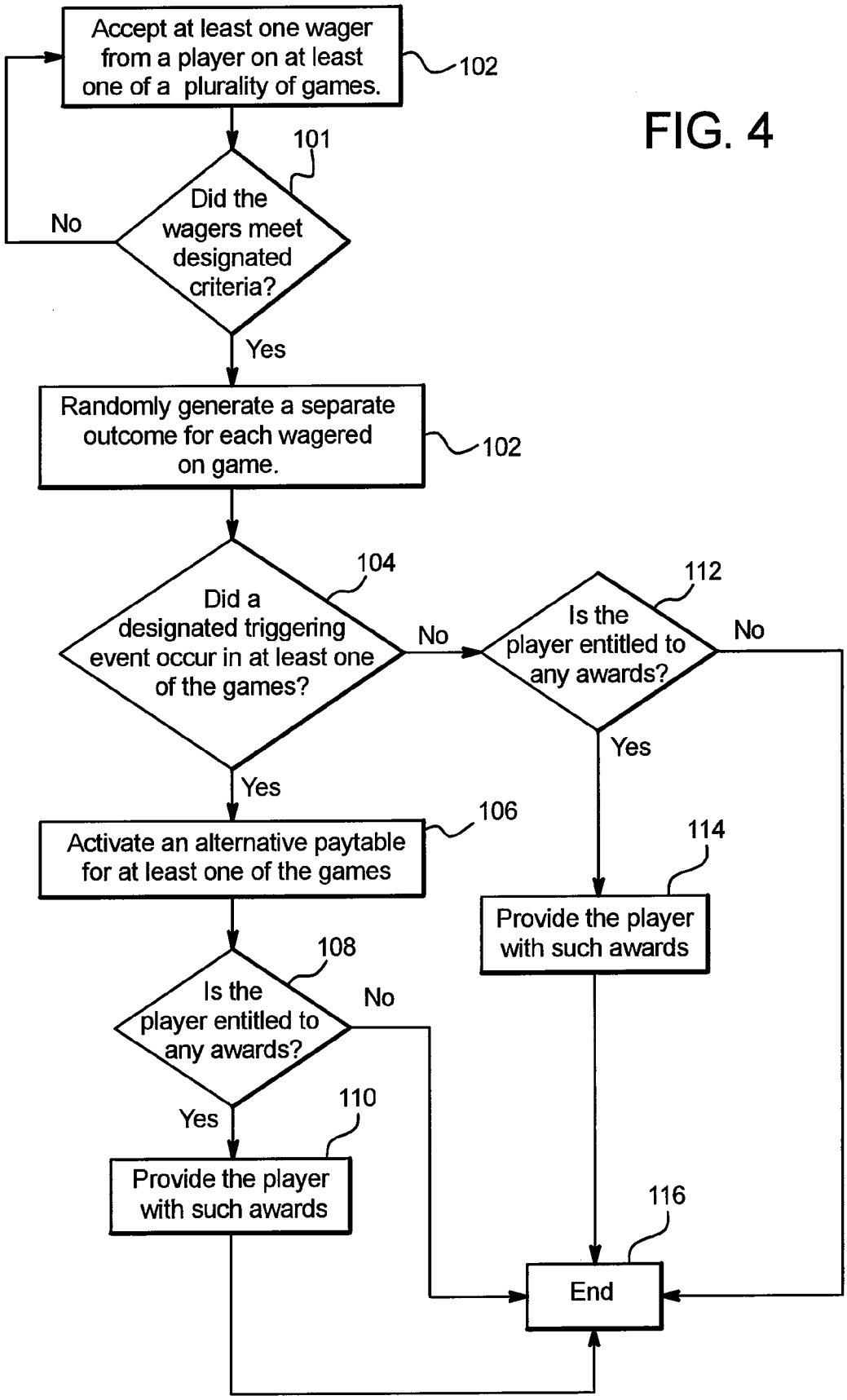
FIG. 4 is a flowchart of an embodiment of the gaming device and method disclosed herein.

Referring now to the flowchart in FIG. 4, the gaming device accepts separate wagers from a player on a plurality of games, as illustrated in block 100. The gaming device determines if the wagers meet a designated criteria, as illustrated in diamond 101. The gaming device generates a separate outcome for each of the wagered on games, as illustrated in block 102. The gaming device determines if a designated triggering event occurs in at least one of the games, as illustrated in diamond 104. If a designated triggering event does not occur during or result from the plays of the games, a player may still be entitled to awards for one or more winning game outcomes. Thus, if a designated triggering event does not occur, the gaming device determines if the player is entitled to any awards using the paytables for each of the respective games, as illustrated in diamond 112. If the player is entitled to any awards, the gaming device provides the player with those awards, as illustrated in block 114. If the player is not entitled to any awards, the game ends, as illustrated in block 116.

Still referring to FIG. 4, if a designated triggering event occurs in at least one of the games, the gaming device activates an alternative paytable for or associated with at least one of the games, as illustrated in block 106. The gaming device uses an alternative paytable to determine awards for one or more plays of at least one of the games, as illustrated in block 108. It should be appreciated that not all paytables used to determine awards for plays of the games in block 108 are necessarily alternative paytables. If the gaming device determines that the player is not entitled to any awards, the game ends. If the gaming device determines that the player is entitled to any awards, the gaming device provides the player with those awards, as illustrated in block 110.

In one embodiment, the designated triggering event is a winning game outcome. In this embodiment, the occurrence of a winning game outcome in one of the games causes the gaming device to modify the paytable of another of the games by applying an incremented modifier to at least one award in that paytable.

Figure 5B:
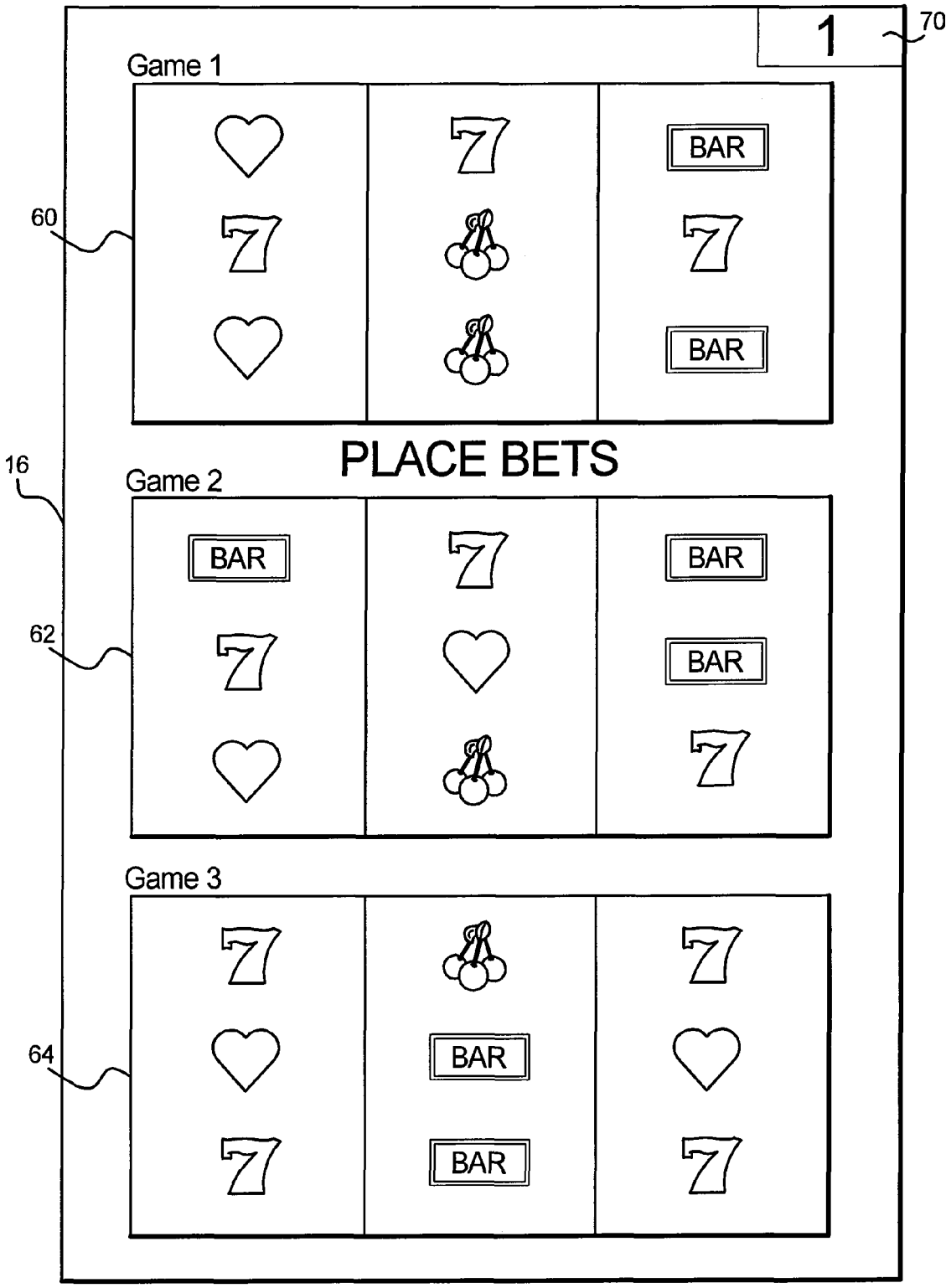
Figure 5C:
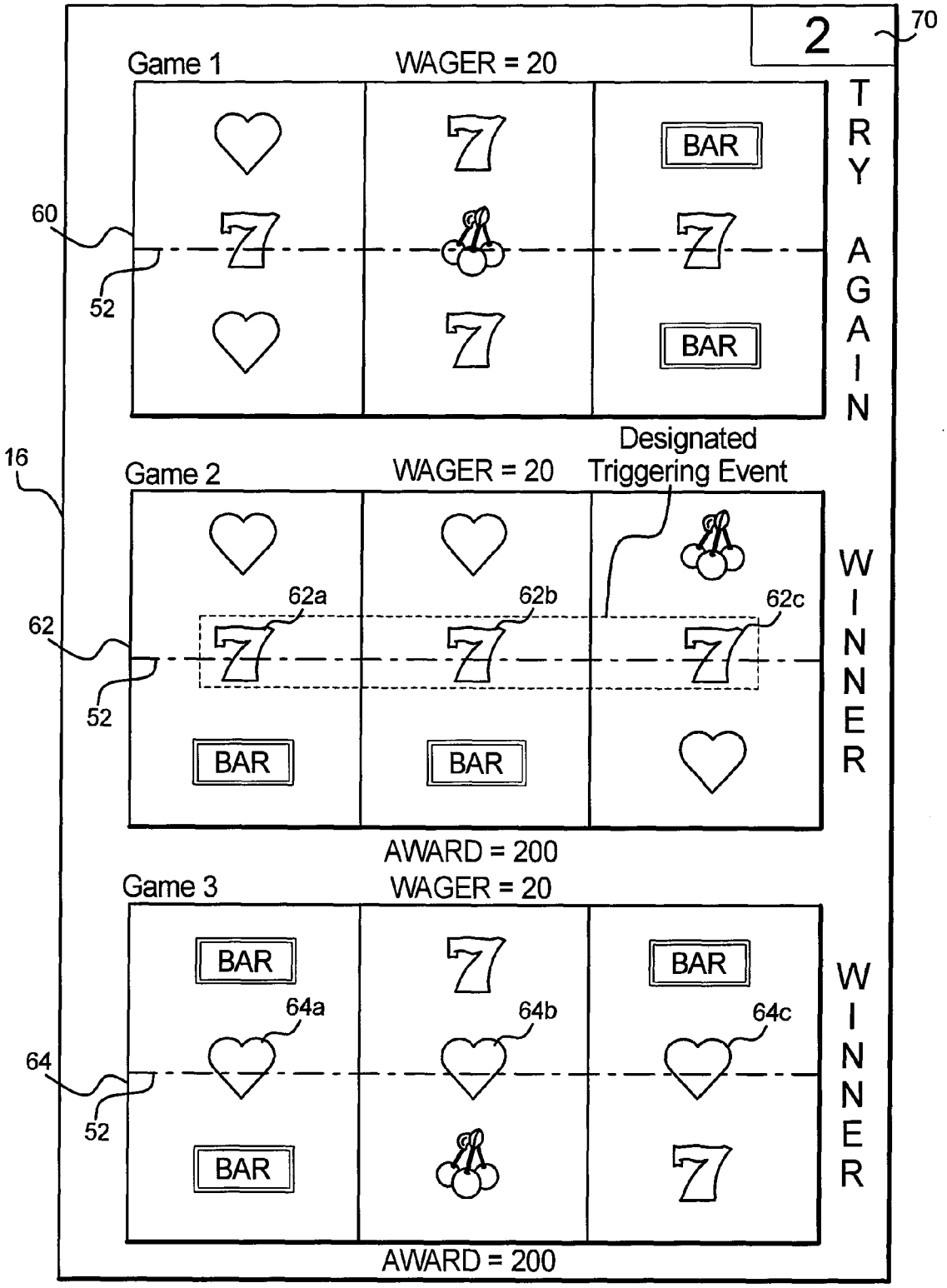

An example of such an embodiment is illustrated in FIGS. 5A, 5B, 5C, 5D and 5E. FIG. 5A illustrates simple example default paytables 80, 82 and 84, each respectively associated with primary games 60, 62 and 64. Paytables 80, 82 and 84 each include winning game outcomes and awards associated with those winning game outcomes. It should be appreciated that each paytable also includes losing game outcomes (not shown). In this embodiment, the award a player receives for a winning game outcome in each of the games is equal to the award as determined in the respective paytable for each game multiplied by the wager the player placed on each respective game or a payline in each respective game. In this embodiment, all three primary games 60, 62 and 64 are slot-type games, as illustrated in FIG. 5B. The gaming device simultaneously displays all three primary games within the central display device 16. The player simultaneously or substantially simultaneously places a separate wager on each of the three primary games 60, 62 and 64, as illustrated in FIG. 5B. In this example, the player places a wager of 20 credits on each of the three primary games 60, 62 and 64, as illustrated in FIG. 5C. The gaming device simultaneously, substantially simultaneously or sequentially generates a separate outcome for each of the three primary games 60, 62 and 64, those outcomes illustrated in FIG. 5C. It should be appreciated that the gaming device generates an outcome for each of the three primary games 60, 62 and 64, regardless of the outcome of the other primary games.

Figure 5E:
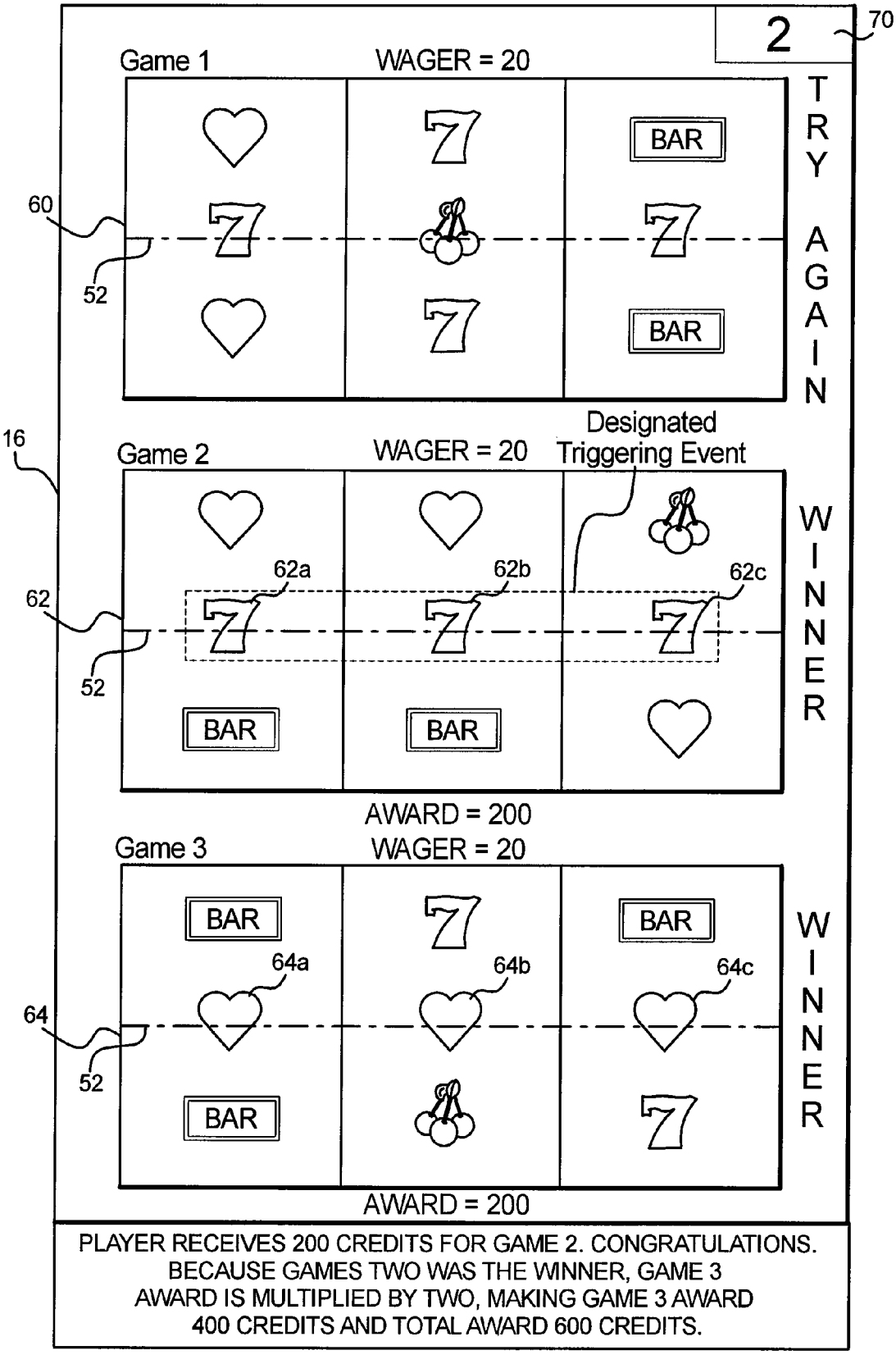

In one embodiment, the gaming device includes a modifier meter 70 including a value, as illustrated in FIGS. 5B, 5C and 5E. At the beginning of play of the games, the value in the modifier meter is set at a default value. In this embodiment, the default value in the modifier meter 70 is one, as illustrated in FIG. 5B. It should be appreciated that the default modifier value may be any suitable value. In different embodiments, the default modifier value is predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

Upon the occurrence of a designated triggering event, such as a winning game outcome, the gaming device increments the value in the modifier meter 70 by any suitable amount, such as one, and multiplies the awards in the paytable of another of the games by the newly incremented value in the modifier meter 70. For example, the gaming device generates a losing outcome (or non-winning symbol combination along payline 52) for the first primary game 60, as illustrated in FIG. 5C. Thus, the player does not receive an award for the first primary game 60 and the value in the modifier meter 70 remains at one (because the designated triggering event does not occur). In contrast, the gaming device generates an outcome of three identical symbols 62*a*, 62*b* and 62*c* along payline 52 in the second primary game 62. This is a winning outcome in the second primary game 62, as illustrated in the paytable 82 in FIGS. 5A and 5D. Thus, the gaming device provides the player with an award for the second primary game 62 equal to 200 credits (10 credit award multiplied by wager of 20), as illustrated in FIG. 5E.

Further, in this embodiment, the winning game outcome in the second primary game 62 is also a designated triggering event, as illustrated in FIG. 5C. Thus, the gaming device increments the value in the modifier meter 70 from one to two (modifier value of one plus increment amount of one). The gaming device then modifies the paytable 84 of the third primary game 64 by multiplying the awards therein by the incremented modifier value of two, as illustrated in FIG. 5D. In other embodiments, multiple paytables may be modified. In different embodiments, the gaming device may increment the modifier by any suitable value which is predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

The gaming device generates an outcome of three identical symbols 64*a*, 64*b* and 64*c* along payline 52 in the third primary game 64, as illustrated in FIG. 5C. This is a winning outcome in the third primary game. Thus, the gaming device determines what award the player receives from the modified paytable 84, as illustrated in FIG. 5D. The gaming device provides the player with an award for the third primary game 64 equal to 400 credits (10 credit award multiplied by modifier of two multiplied by wager of 20), as illustrated in FIG. 5E.

In different embodiments, the gaming device may determine which paytable to modify upon the occurrence of a designated triggering event in a variety of ways. The gaming device may assign the games a hierarchal order (such as left to right or top to bottom), such that if the designated triggering event occurs, the gaming device modifies the paytable of a next game (below or to the right). In other embodiments, the gaming device may assign the games such a hierarchy in a non-linear fashion. For example, if a designated triggering event occurs, the gaming device may modify the paytable for another game occurring three games subsequent or may modify the paytable for a randomly selected game.

It should be appreciated that the simultaneous, substantially simultaneous or sequential primary game play illustrated in FIGS. 5B, 5C and 5E is not limited to the play of three primary games, but may include the play of any suitable number of games. Further, although the embodiment illustrated in FIGS. 5B, 5C and 5E includes slot-type games, in other embodiments, a player plays different types of games. For example, in one such embodiment, the first primary game 60 is a video poker game and the second and third primary games 62 and 64 are slot-type games. The occurrence of a designated triggering event in the slot-type game causes the gaming device to modify the paytable of a video poker game.

In another embodiment, the designated triggering event is the occurrence of one or more bonus game triggering events during the play of a plurality of primary games. In this embodiment, the occurrence of a designated triggering event causes the gaming device to modify awards associated with bonus game outcomes in the paytable of at least one of a plurality of primary games.

It should be appreciated that in certain embodiments disclosed herein, bonus game outcomes and their respective awards may be associated with: (a) the paytable of the primary game associated with each respective bonus game; (b) a separate bonus game paytable associated with each respective bonus game; (c) a combined paytable including primary game outcomes and awards and bonus game outcomes and awards; or (d) any suitable paytable.

Figure 6:
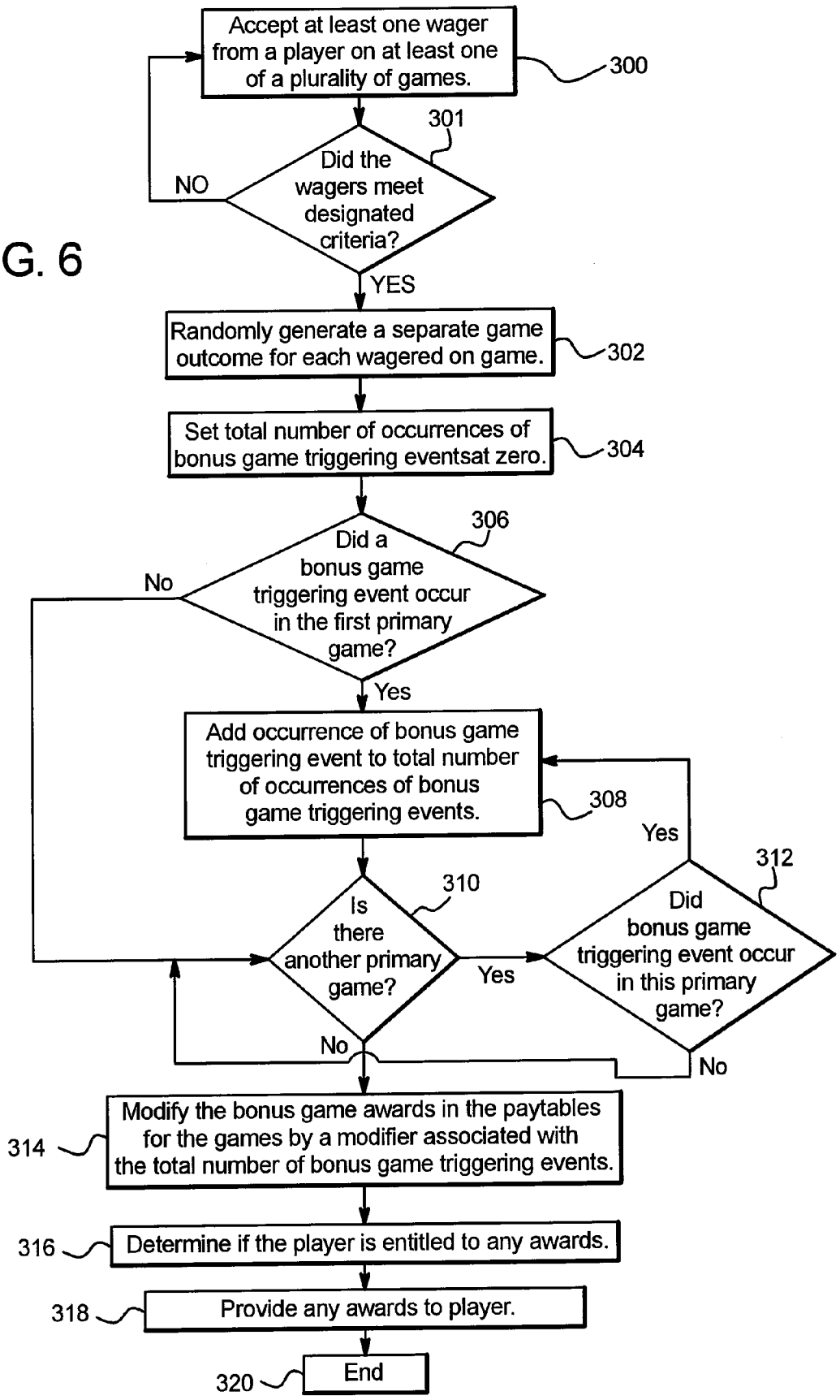
FIG. 6 is a flowchart of one embodiment of the gaming device and method disclosed herein.

Referring now to the flowchart in FIG. 6, the gaming device records the total number of bonus game triggering events occurring during the play of a plurality of primary games. The gaming device determines if the wagers meet a designated criteria, as illustrated in diamond 301. The gaming device initially sets this total number at zero, as illustrated in block 304. The gaming device determines whether a bonus game triggering event occurs in a first primary game, as illustrated in diamond 306. If a bonus game triggering event occurs, the gaming device adds the occurrence to the total number of occurrences in block 308. The gaming device repeats this determination until it makes the determination for all wagered on primary games, as illustrated by diamonds 310 and 312.

The bonus game triggering events in the primary games trigger bonus games. The paytables for or associated with each of the wagered on primary games include awards for outcomes in those bonus games. The gaming device applies a modifier associated with the total number of bonus game triggering events occurring during play of the primary games to the bonus game awards in those paytables, as illustrated in block 314. In one embodiment, the modifier in block 314 equals the total number of bonus game triggering events occurring during play of the plurality of primary games. In different embodiments, the modifier may be predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

An example of such an embodiment is illustrated in FIGS. 7A, 7B, 7C, 7D, 7E and 7F. The occurrence of a designated triggering event, such as the occurrence of at least one bonus game triggering event during the play of a plurality of primary games, causes the gaming device to multiply the bonus awards in the paytable of at least one of those games by a value equal to the total number of bonus game triggering events occurring during the play of those games.

Referring now to FIG. 7A, the paytables 80, 82 and 84 include primary game winning outcomes and bonus game winning outcomes each associated with respective awards.

Figure 7B:
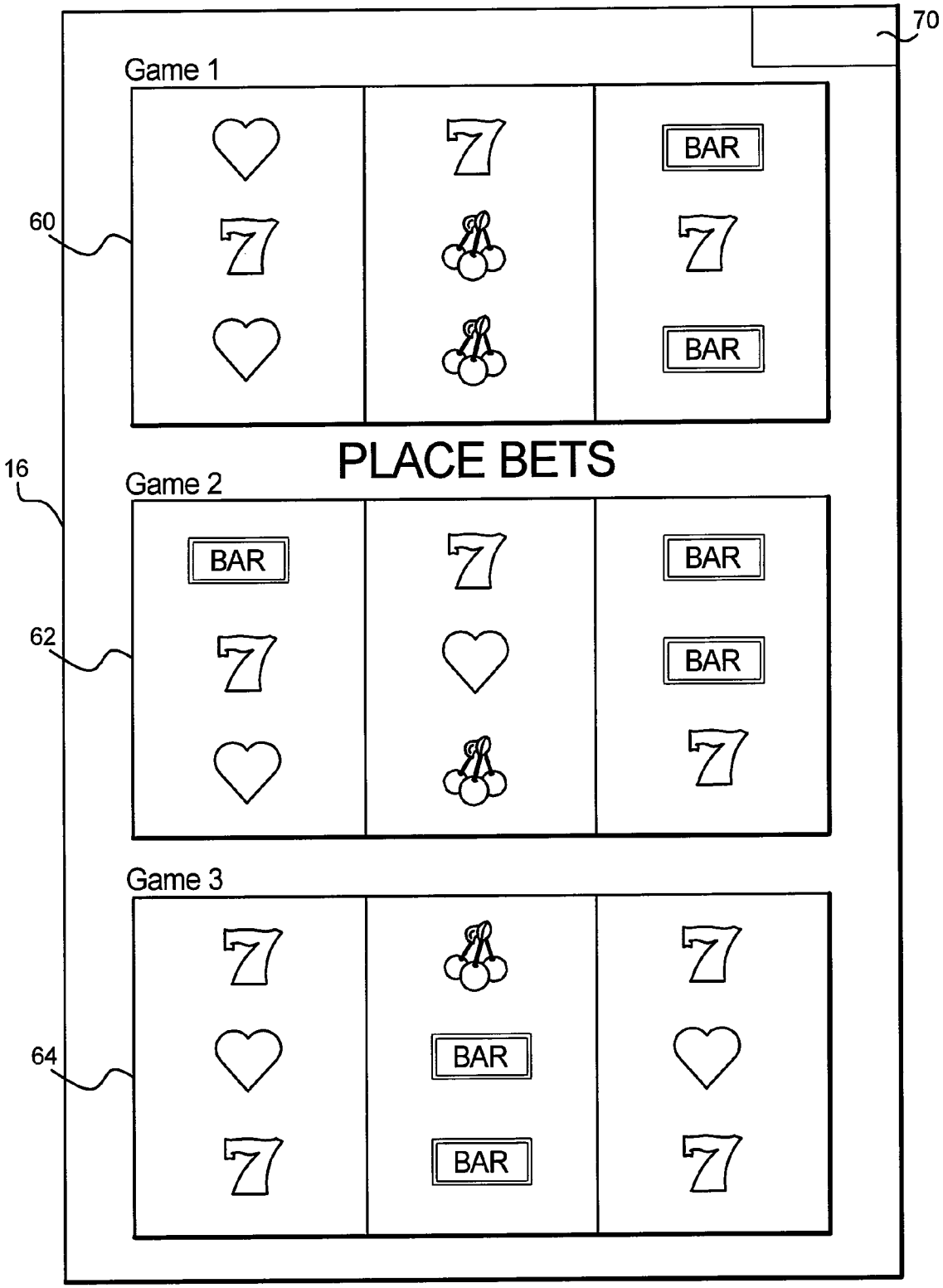
Figure 7C:
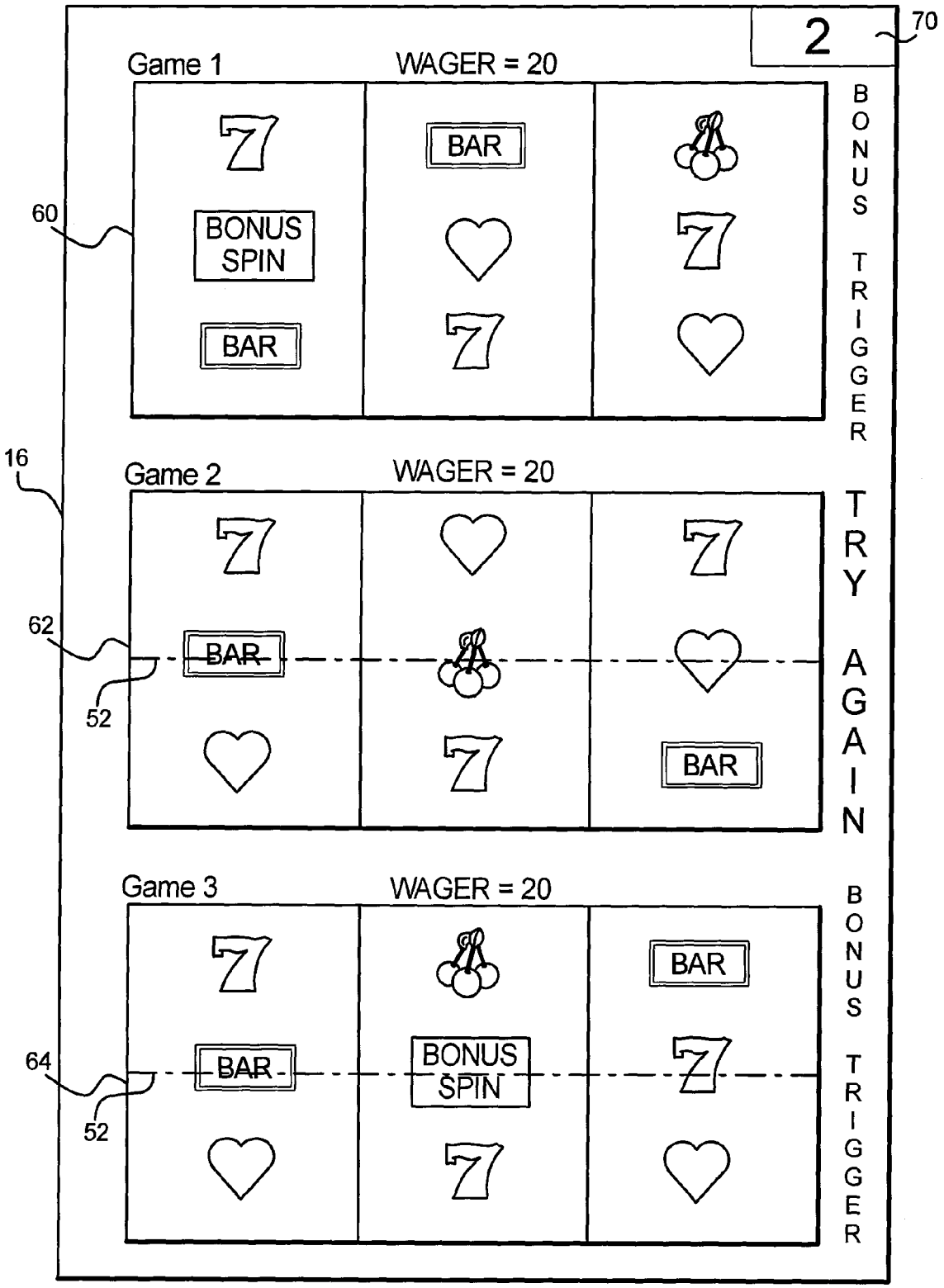

The gaming device prompts the player for a wager, as illustrated in FIG. 7B. In this embodiment, the value in the modifier meter 70 represents the total number of bonus game triggering events, such as the awarding of bonus spins, occurring during play of the primary games 60, 62 and 64. In this embodiment, each of the primary games 60, 62 and 64 generate independent outcomes. It should be appreciated that these outcomes may be generated sequentially, simultaneously or substantially simultaneously. The player receives a bonus spin during play of the first primary game 60 and the third primary game 64, as illustrated in FIG. 7C. Thus, the value in the modifier meter 70 is two upon completion of play of the three primary games 60, 62 and 64, as illustrated in FIG. 7C. In this embodiment, the gaming device multiplies the awards associated with winning bonus game outcomes in the paytables 80, 82 and 84 by the value of two in the modifier meter 70, as illustrated in FIG. 7E.

Figure 7D:
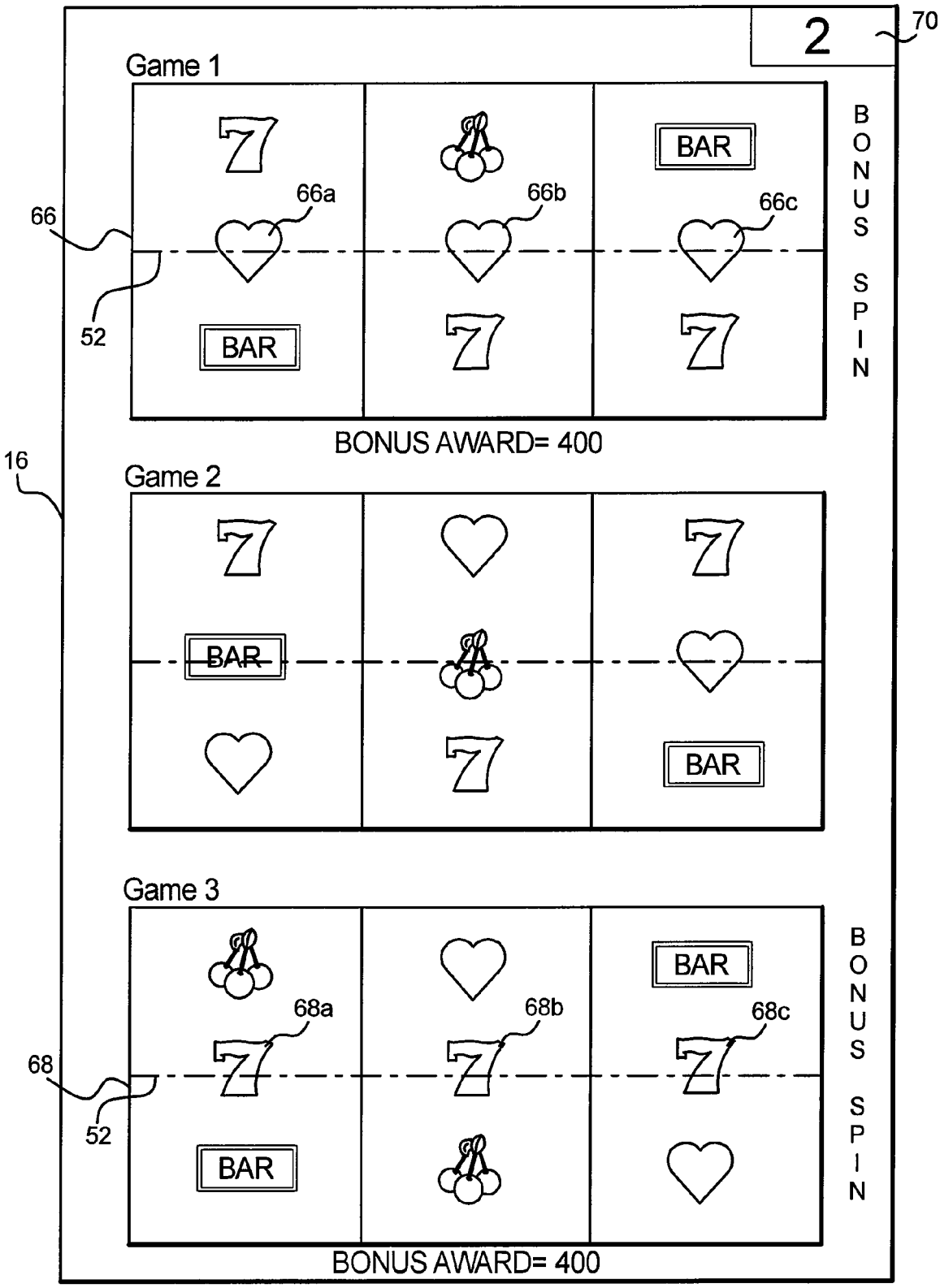
Figure 7F:
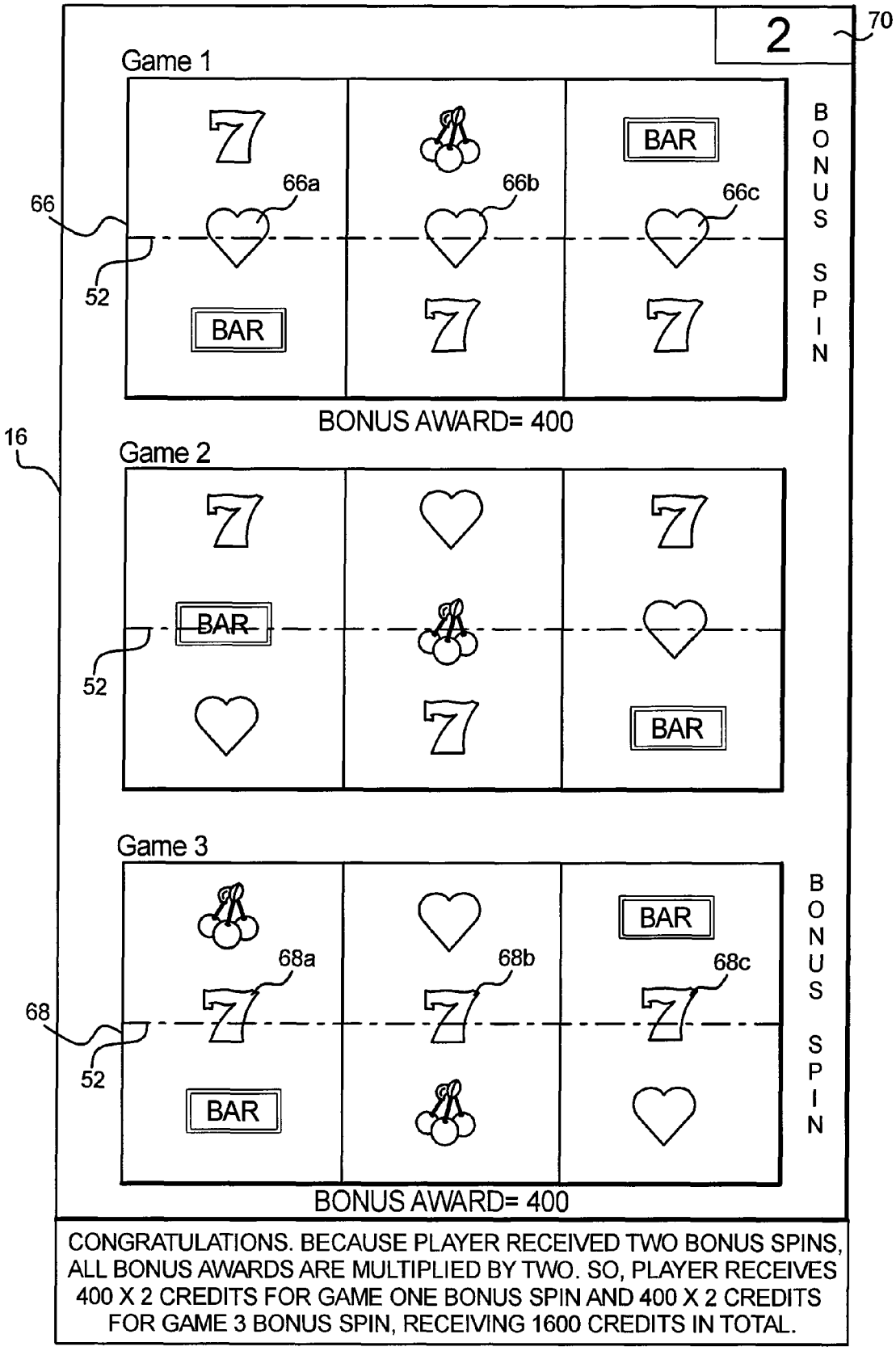

The gaming device generates winning game outcomes for bonus games 66 and 68, as illustrated in FIG. 7D and paytables 80 and 84 in FIGS. 7A and 7E. Thus, the gaming device determines awards for bonus games 66 and 68 from respective paytables 80 and 84. Each award provided to the player equals the number of credits wagered on each respective primary game multiplied by the award in each paytable 80 and 84 associated with each respective bonus game outcome. In this example, the paytables 80 and 84 have been modified as previously discussed. Thus, the player ultimately receives 800 credits (wager of 20 multiplied by award of 40 multiplied by modifier of two) for bonus game 66 and 800 credits (wager of 20 multiplied by award of 40 multiplied by modifier of two) for bonus game 68, receiving 1600 credits in total, as illustrated in FIG. 7F.

In another embodiment, the occurrence of a designated triggering event during the play of a plurality of games causes the gaming device to activate a supplementary paytable associated with a secondary game. In one such embodiment, the designated triggering event is the occurrence of a designated symbol in one of a plurality of games and the secondary game is an accumulation game.

Figure 8:
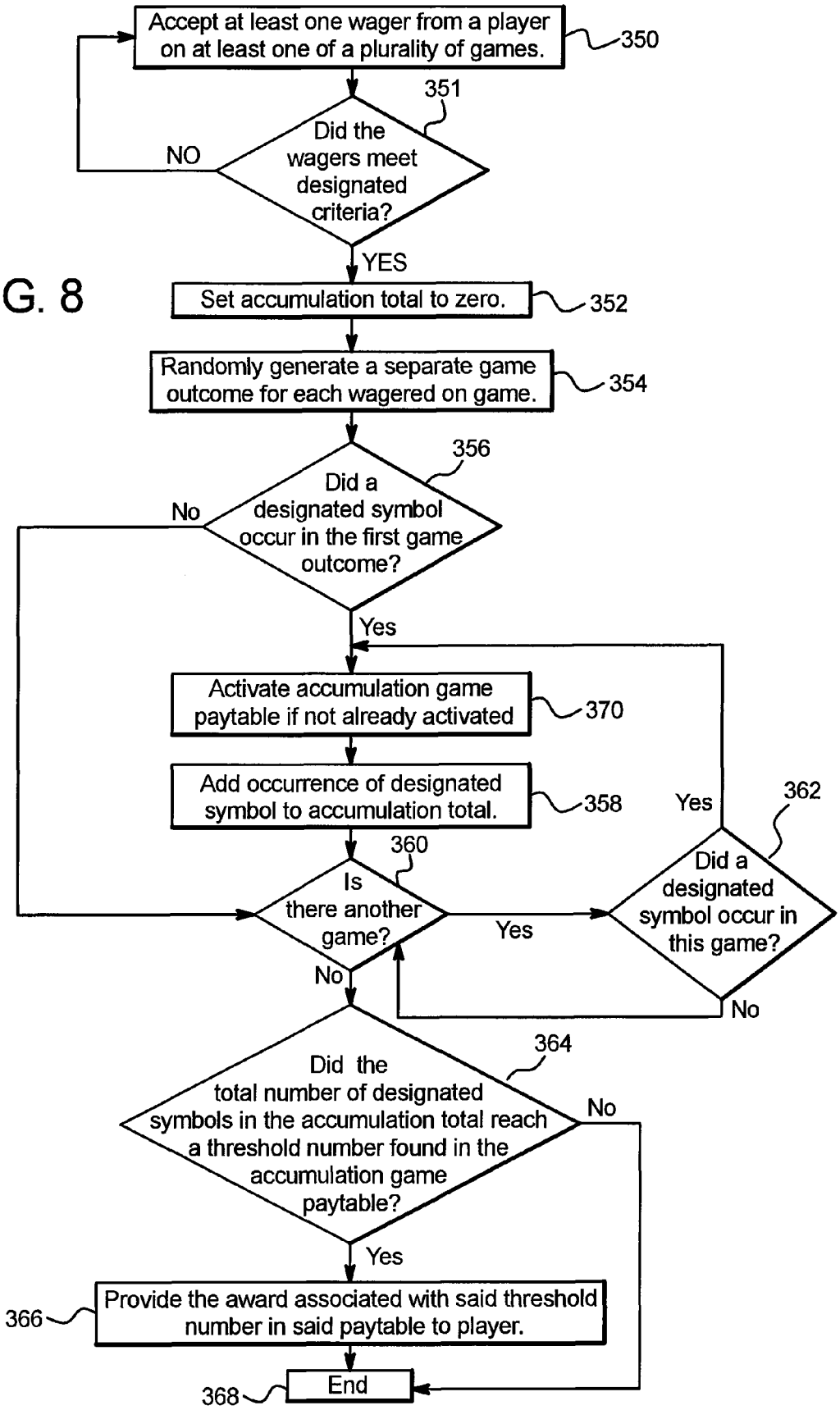
FIG. 8 is a flowchart of one embodiment of the gaming device and method disclosed herein.

Referring now to the flowchart in FIG. 8, the gaming device accepts separate wagers from a player on a plurality of games, as illustrated in block 350. The gaming device determines if the wagers meet a designated criteria, as illustrated in diamond 351. The gaming device randomly generates outcomes for the plurality of games, as illustrated in block 354. In this embodiment, the gaming device includes an accumulation total which is initially set to zero, as illustrated in block 352. The accumulation total may be initially set at any suitable number. In different embodiments, the initial value in the accumulation total may be predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

In this embodiment, each of the primary games includes one or more designated symbols of a secondary or accumulation game. If a designated symbol occurs in one of the games, the gaming device activates an accumulation game paytable, as illustrated in block 370. The gaming device accumulates the number of designated symbols it generates during the play of the primary games in the accumulation total, as illustrated in block 358. Each time a designated symbol occurs, the gaming device adds the occurrence to the accumulation total, as illustrated in block 358. If the gaming device determines that the number of designated symbols reaches a threshold number found in the accumulation game paytable, the gaming device provides the player with the award associated with that threshold number in the accumulation game paytable, as illustrated in block 366. It should be appreciated that if the gaming device determines that the number of designated symbols accumulated in the accumulation game does not reach a threshold number, the gaming device still provides the player with awards for the individual play of the wagered on games, where applicable.

Figure 9A:
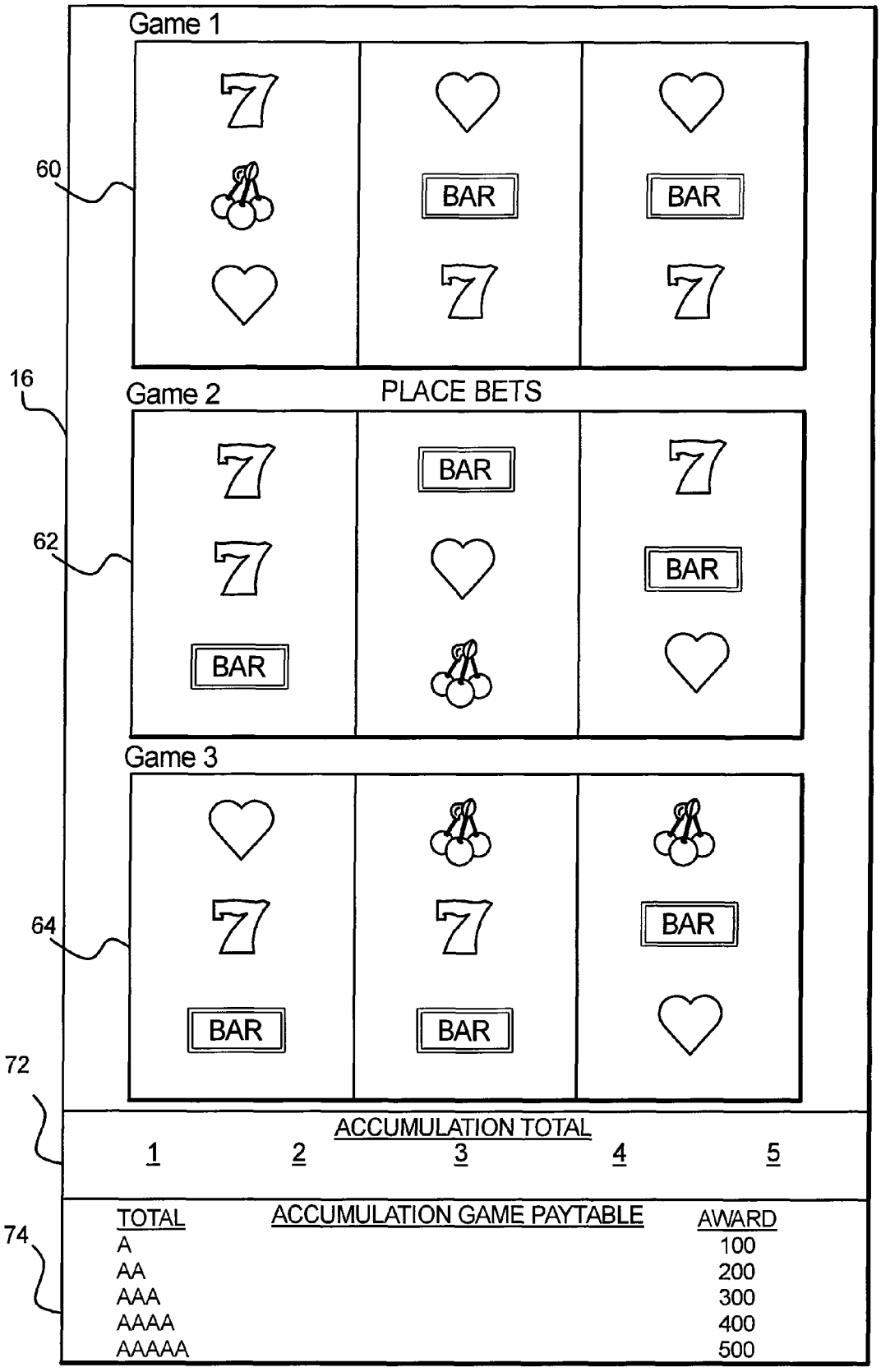
FIGS. 9A, 9B and 9C are front views of a gaming device display enabling the simultaneous, substantially simultaneous or sequential play of three games in accordance with one embodiment of the gaming device disclosed herein.
Figure 9B:
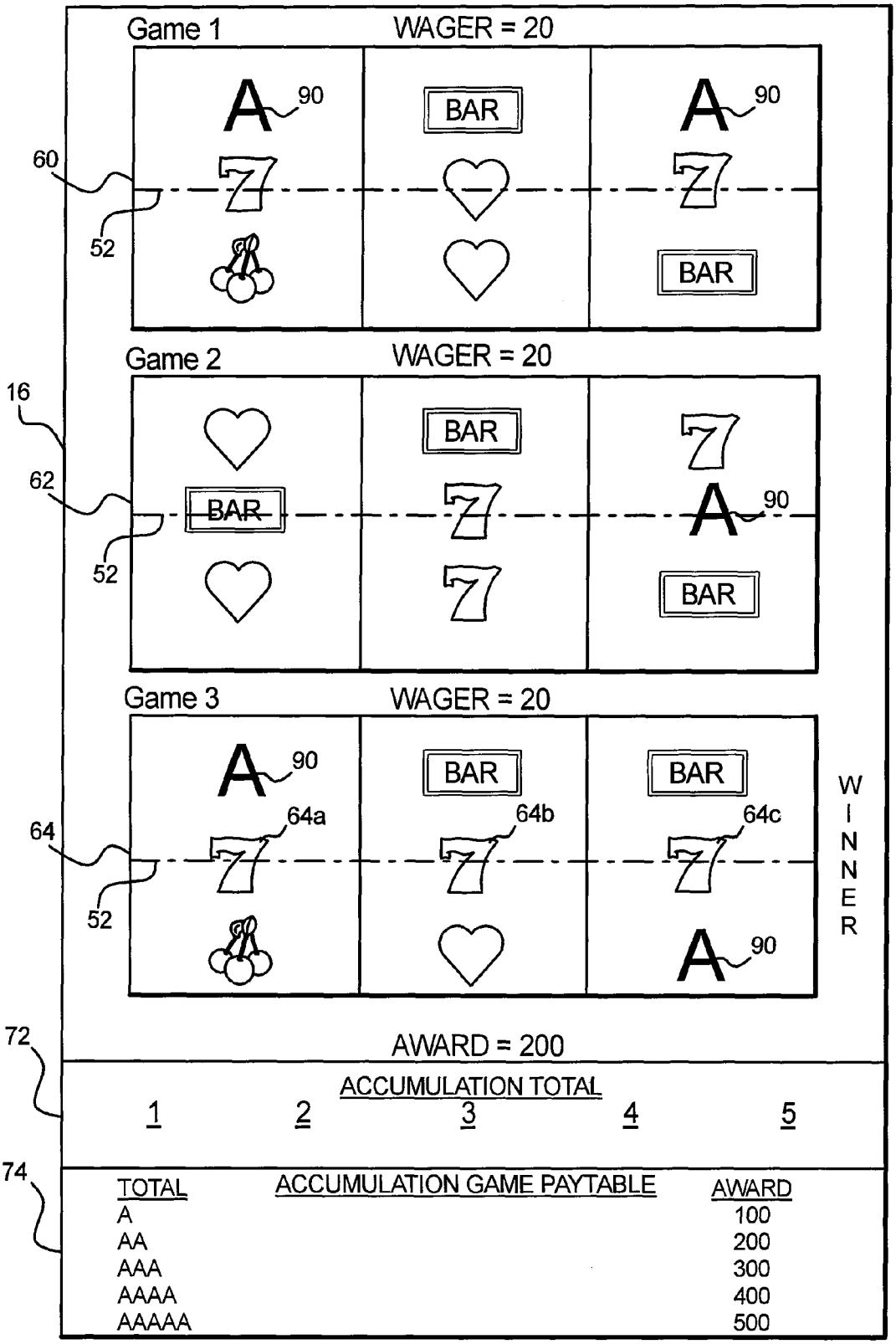
Figure 9C:
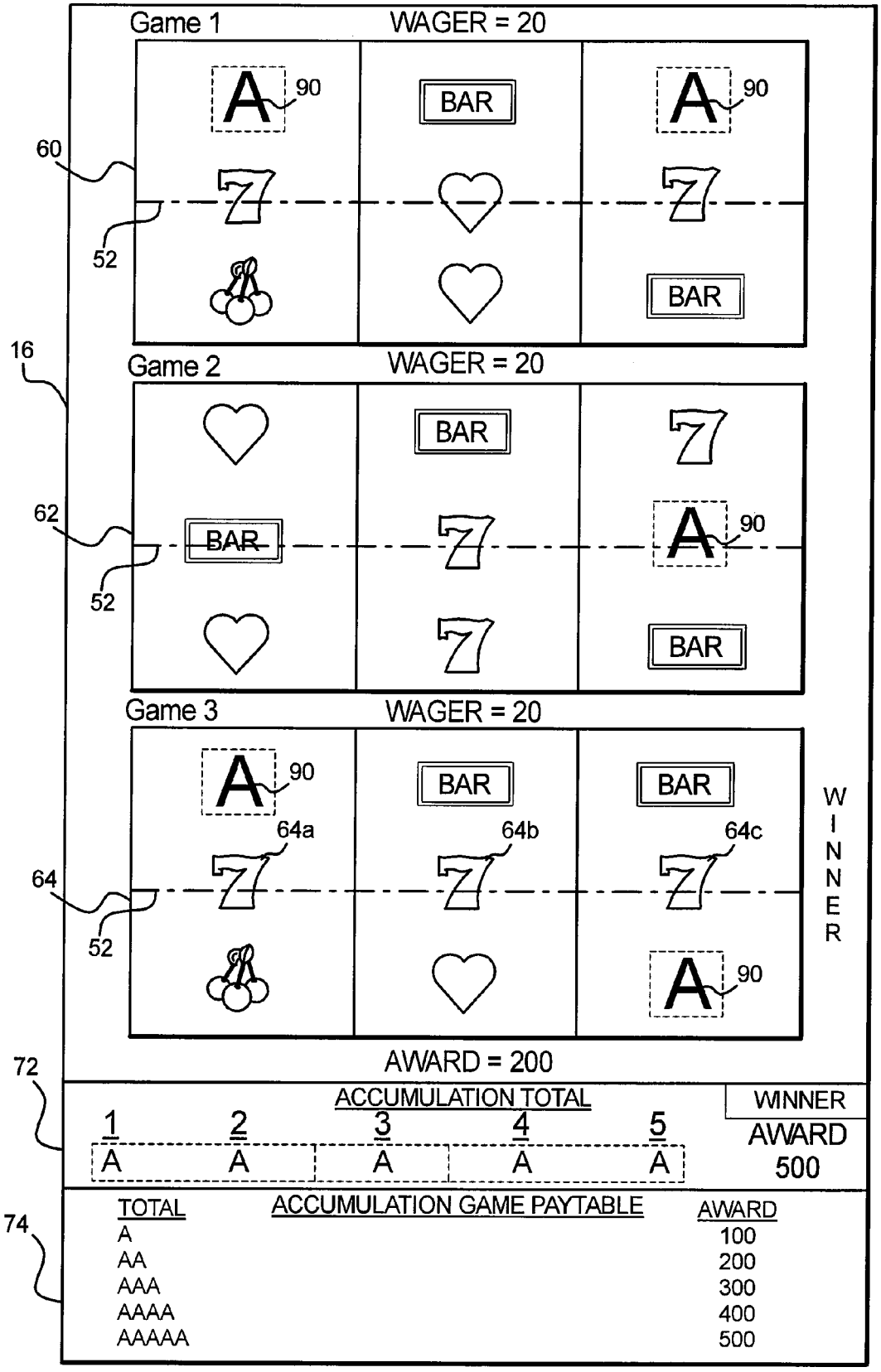

An example of such an embodiment is illustrated in FIGS. 9A, 9B and 9C. The accumulation game paytable 74 is activated upon the occurrence of one of the designated symbols 90. In this embodiment, the gaming device also includes an accumulation total 72. Once a designated symbol 90 occurs, the gaming device enables the player to play an accumulation game in addition to the primary games, wherein the gaming device accumulates designated symbols 90 generated in each of the separately played primary games 60, 62 and 64 and provides the player with an award if the number of designated symbols 90 reaches a threshold number constituting a winning game outcome in the accumulation game paytable 74.

The gaming device generates a losing outcome (or non-winning symbol combination along payline 52) for the first primary game 60, as illustrated in FIG. 9B. Thus, the player does not receive an award for the first primary game 60. However, the gaming device generates two designated symbols 90 in the first primary game 60. Thus, the gaming device records two occurrences of the designated symbol 90 in the accumulation total 72, as illustrated in FIG. 9C.

Similarly, the gaming device generates a losing outcome for the second primary game 62, as illustrated in FIG. 9B. Thus, the player does not receive an award for the second primary game 62. However, the gaming device generates a designated symbol 90 in the second primary game 62. Thus, the gaming device records one occurrence of the designated symbol 90 in the accumulation total 72, as illustrated in FIG. 9C.

Three identical symbols 64*a*, 64*b* and 64*c* occur along payline 52 in the third primary game 64, as illustrated in FIG. 9B. This is a winning outcome in the third primary game 64. Thus, the player receives an award for the third primary game 64 equal to 200 credits, as illustrated in FIG. 9B. Further, the gaming device generates two designated symbols 90 in the third primary game 64. Thus, the gaming device records two occurrences of the designated symbol 90 in the accumulation total 72, as illustrated in FIG. 9C.

Since the accumulation of five designated symbols 90 (two, one and two from primary games 60, 62 and 64, respectively) in the accumulation game total 72 is a winning game outcome in the accumulation game paytable 74, the gaming device provides the player with the award of 500 credits in addition to the award the player receives for the winning symbol combination on payline 52 in the third primary game 64, as illustrated in FIG. 9C.

It should be appreciated that in different embodiments, the awards in the paytable 74 may also include: (a) a retrigger of the wagered on primary games; (b) one or more bonus games (i.e., a wheel game); or (c) any other suitable award. In various embodiments, different numbers of designated symbols or different designated symbols may be respectively associated with different bonus games. In one such embodiment, bonus games associated with higher numbers of designated symbols may be associated with higher awards. It should be further appreciated that the accumulation game may last over a set number of wagered games.

In alternative embodiments, the gaming device may accumulate designated symbols in such an accumulation game (secondary game) from bonus games associated with the wagered on primary games. In such an embodiment, the gaming device records the total number of occurrences of the designated symbol during the play of the bonus games. If the total number of designated symbols reaches a threshold number which constitutes a winning game outcome in the paytable of the accumulation game, the gaming device provides the player with an award from said paytable.

In further alternative embodiments, the gaming device may accumulate designated symbols in an accumulation game (secondary game) from both the wagered on primary games and from bonus games associated with those wagered on primary games. In such an embodiment, the gaming device records the total number of occurrences of the designated symbol during the play of the primary games and any resulting bonus games. If the total number of designated symbols reaches a threshold number constituting a winning game outcome in the paytable of the accumulation game, the gaming device provides the player with an award from said paytable.

In another embodiment, the designated triggering event is the occurrence of a predetermined symbol or set of symbols in one or more primary games. This causes the gaming device to add one or more outcomes each associated with an award to the paytable for or associated with at least another primary game.

Figure 10A:
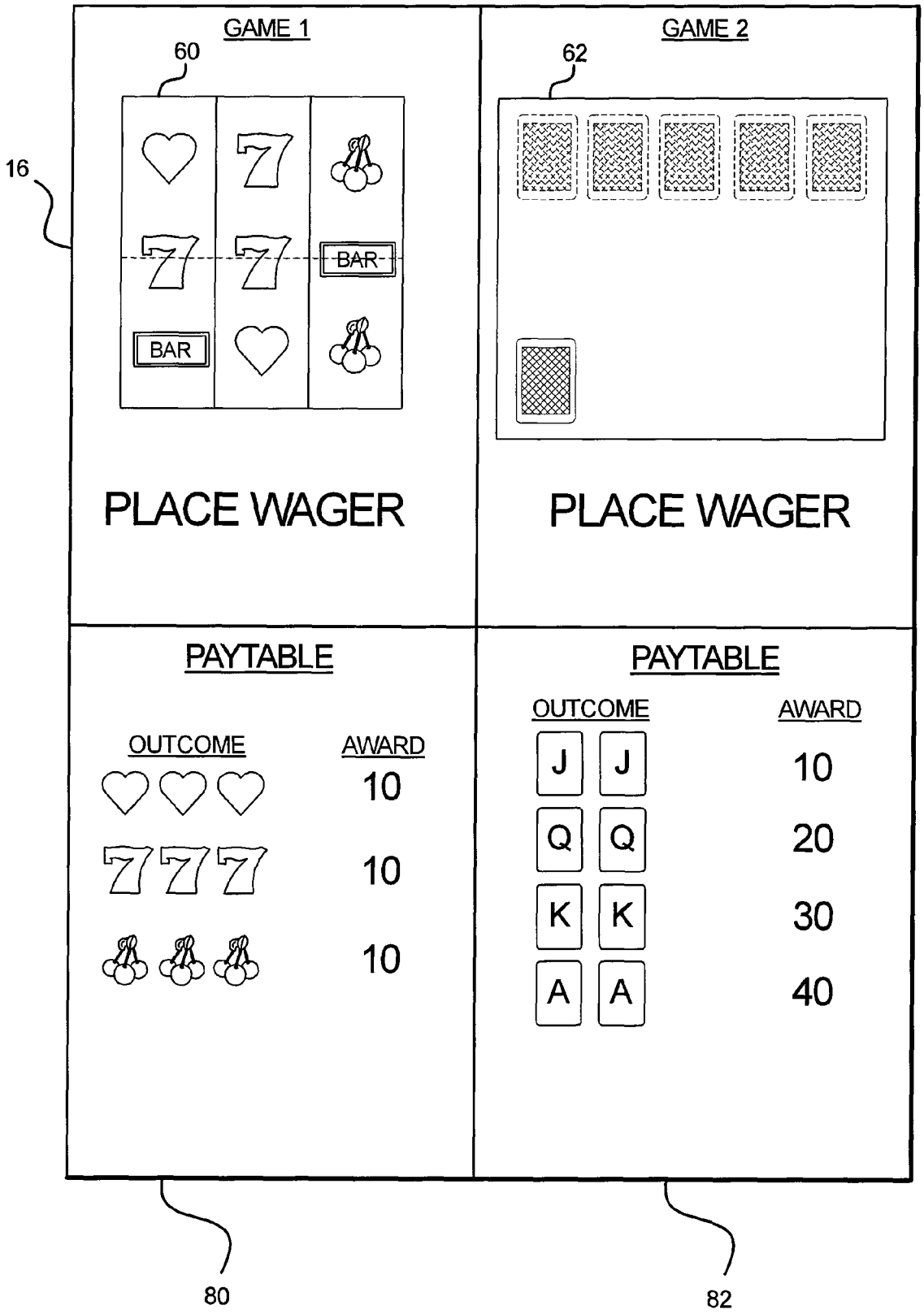
FIGS. 10A and 10B include front views of a gaming device display enabling the simultaneous, substantially simultaneous or sequential play of two games in accordance with one embodiment of the gaming device disclosed herein.
Figure 10B:
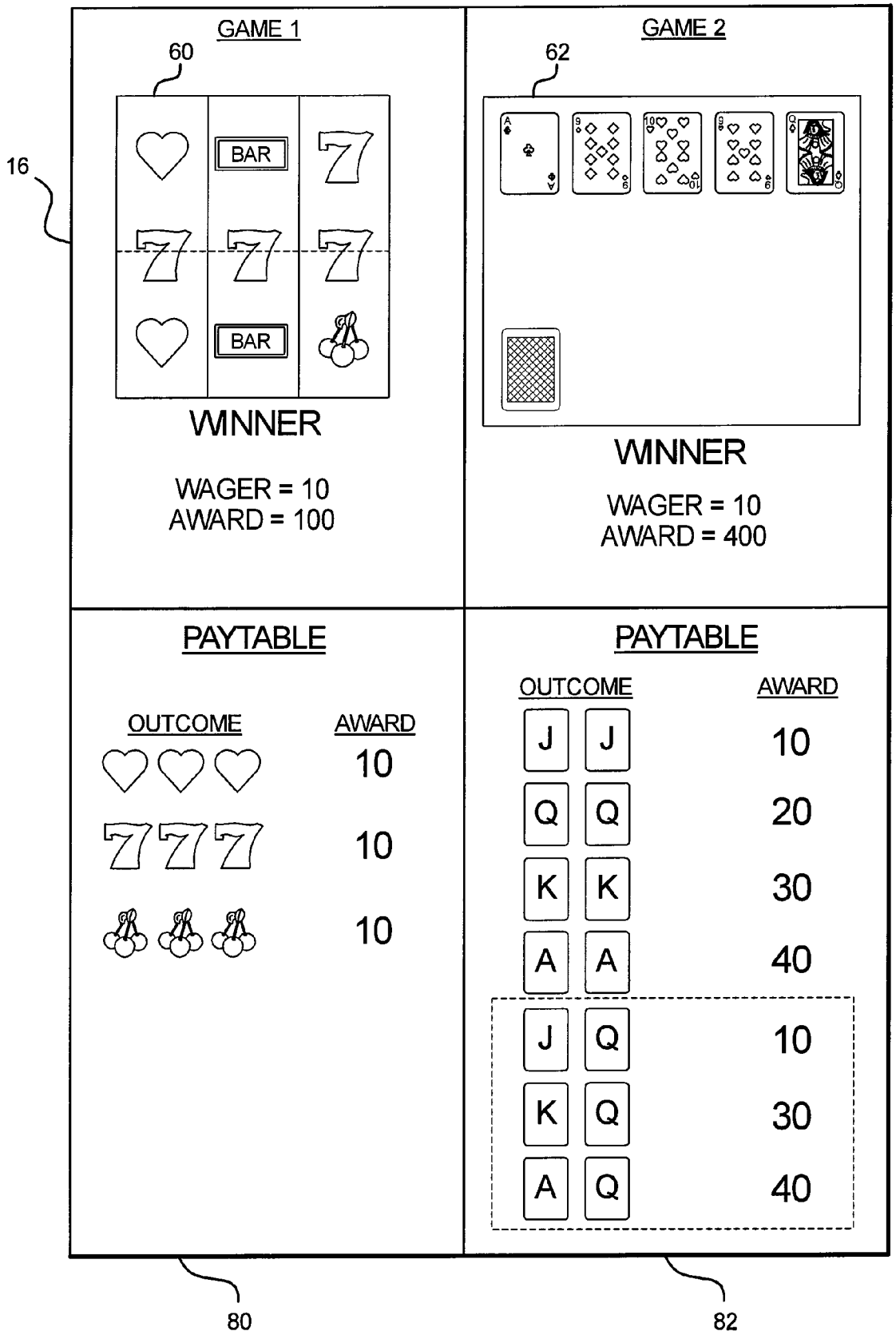

For example, now referring to FIGS. 10A and 10B, a player simultaneously wagers on both a first primary game (slot-type game) 60 and a second primary game (video poker game) 62. It should be appreciated that in other embodiments, the first primary game 60 and the second primary game 62 are the same type of game. Each primary game 60 and 62 has a respective paytable 80 and 82, as illustrated in FIG. 10A. The paytables 80 and 82 include winning game outcomes and associated awards for primary games 60 and 62. The gaming device generates an outcome for the first primary game 60 including three 7's on the payline 52, as illustrated in FIG. 10B. This is a winning game outcome, as illustrated in FIG. 10B. Thus, the player receives an award of 100 credits for the first primary game 60 (wager of 10 multiplied by award of 10).

Further, in this embodiment, the generation of three 7's on a payline in the first primary game 60 is a designated triggering event, causing the gaming device to modify the paytable 82 of the second primary game 62. In this embodiment, the gaming device modifies the paytable 82 such that queens become wild cards. Thus, the gaming device adds winning game outcomes to the paytable 82, as illustrated in FIG. 10B. In this example, the gaming device generates an outcome for the second primary game 62 which includes a queen and an ace. Due to the addition of winning outcomes to the paytable 82, the occurrence of a queen and an ace is now a winning game outcome in the second primary game 62 and the player receives an award of 400 credits for the second primary game 62 (wager of 10 multiplied by award of 40), as illustrated in FIG. 10B.

In another embodiment, a plurality of primary games each have a default paytable and one or more alternative paytables. In this embodiment, the occurrence of a designated triggering event in one of the games causes the gaming device to activate an alternative paytable for determining awards for one or more plays of at least another of the games.

Figure 11B:
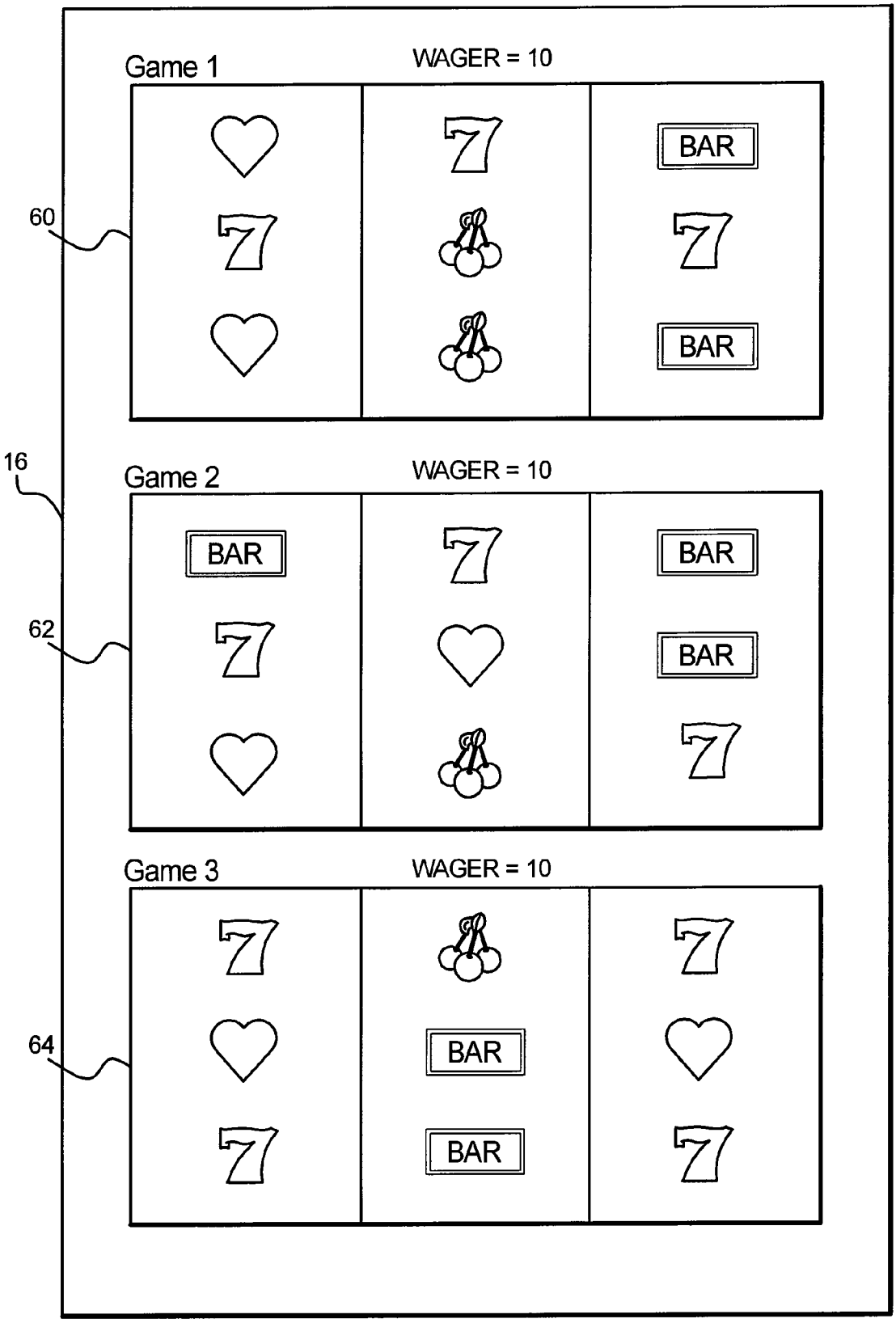
Figure 11C:
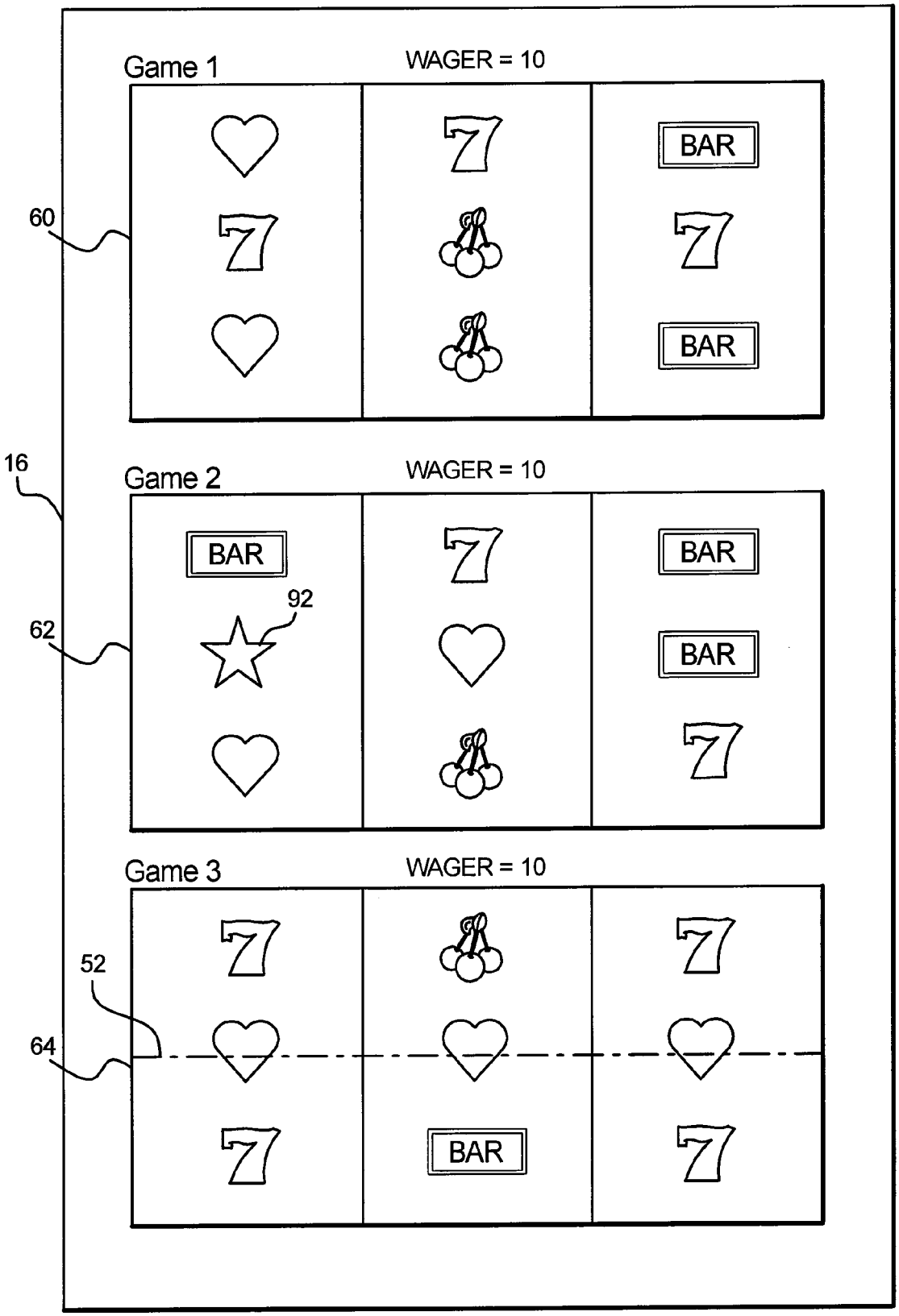

Referring now to FIG. 11A, each of three primary games 60, 62 and 64 have respectively, a paytable 80, 82 and 84 and two alternative paytables 80*a*, 80*b*, 82*a*, 82*b*, 84*a* and 84*b*. A player places a wager of 10 credits on each of the three primary games 60, 62 and 64, as illustrated in FIG. 11B. The gaming device simultaneously, substantially simultaneously or sequentially generates an outcome for each of the three primary games, as illustrated in FIG. 11C.

Figure 11D:
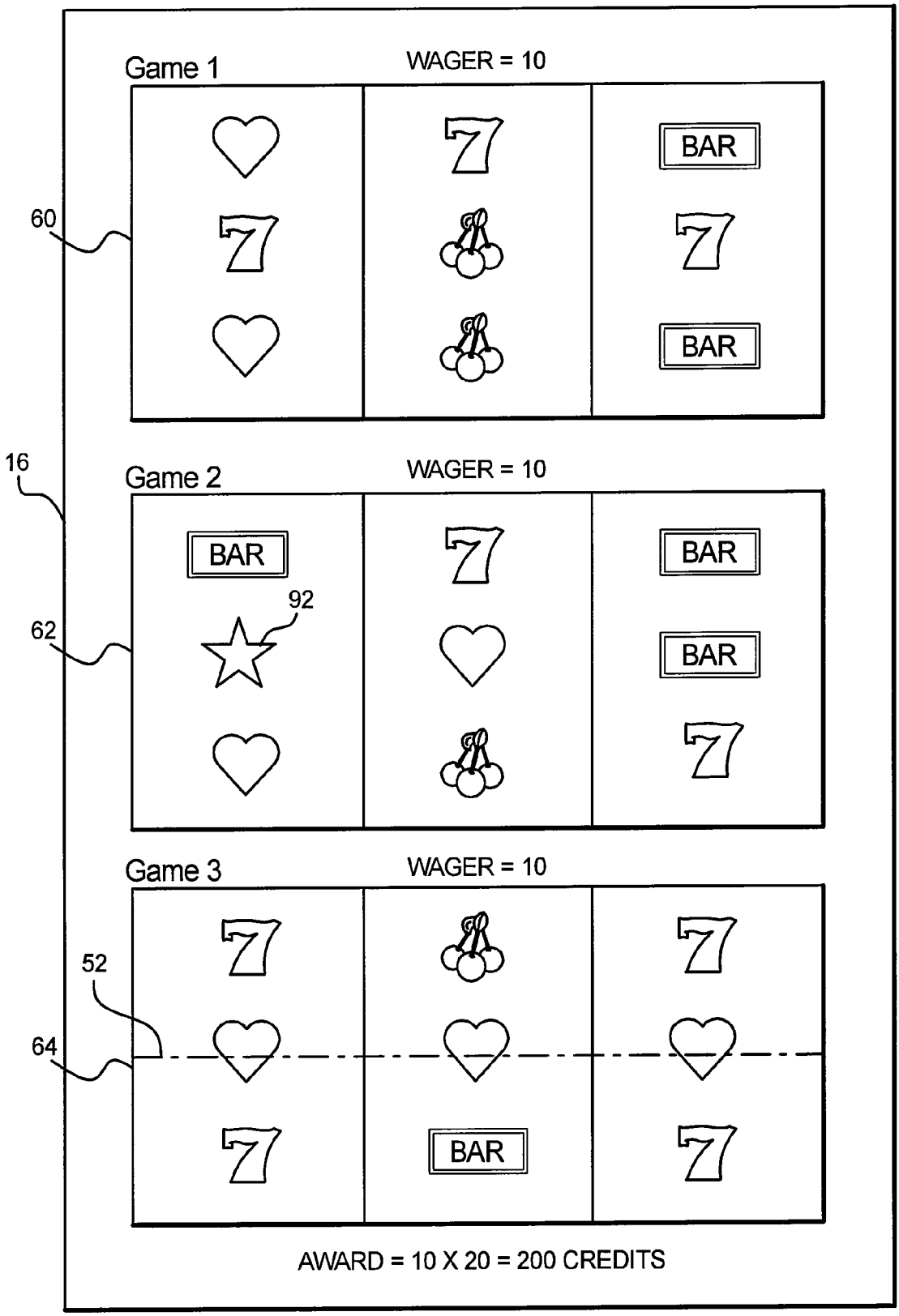

In this embodiment, the occurrence of a star symbol 92 in the outcome of one of the primary games is a designated triggering event, which causes the gaming device to activate an alternative paytable for another of the primary games. A star symbol 92 occurs in the outcome of the second primary game 62, as illustrated in FIG. 11C. Thus, in this embodiment, the gaming device activates the first alternative paytable 84*a* for determining any awards for the third primary game 84. In this example, the gaming device generates a winning outcome along the payline 52 in the third primary game 84, as illustrated in FIG. 11C. The gaming device determines the appropriate award for this winning game outcome from the first alternative paytable 84*a*, as illustrated in FIG. 11A. The gaming device then provides the player with the appropriate award of 200 credits (wager of 10 multiplied by award of 20), as illustrated in FIG. 11D.

In this embodiment, the designated triggering event was the generation of the star symbol 92. It should be appreciated that in different embodiments the designated triggering event may be any suitable symbol, set of symbols or game event.

It should also be appreciated that in this example, each primary game includes two alternative paytables. In other embodiments, each game has or is associated with any number of alternative paytables. Further, the manner in which the gaming device selects which game to activate an alternative paytable for or the manner in which the gaming device selects which alternative paytable of a game to activate is based on any suitable criteria. For example, in the above embodiment, the gaming device activated the first alternative paytable 84*a* for the third primary game 84 upon the occurrence of a star symbol 92 in the second primary game 82. In such an example, the gaming device is configured such that if two star symbols 92 are generated in the outcome of one of the primary games, the gaming device activates the second alternative paytable for another of the games, and so on.

It should be appreciated that in different embodiments, any designated triggering event in any wagered on game may affect one or more games or the paytables associated with those games in any manner. In such embodiments, any designated triggering event causes the gaming device to modify any suitable game feature or paytable of any suitable game. In doing so, the gaming device utilizes game play features including, but not limited to: modifiers; multipliers; mathematical operators; split symbols; moving symbols; sub-symbols; changing symbols; locking reels; wild reels; payline modifiers; scatter evaluations; ways to win evaluations; forming/activating new paylines; additional winning symbol combinations that are independent of the paytable; activating symbol positions; symbol evaluation modifiers; holds;

respins; bonus games; bonus awards; reel/slot games; card games (e.g., poker, blackjack); lottery games; selection games; offer and acceptance games; wheel games; dice games; free spin games; competition games; skill games; perceived skill games; any other suitable game play feature otherwise known or any combination thereof.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device storing a plurality of instructions, which when executed by the at least one processor, cause the at least one processor to operate with the at least one display device and the at least one input device to:

(i) enable a player to place a total wager associated with a plurality of distinct wagers on a plurality of simultaneous plays of a plurality of separate games; and (ii) after receiving the total wager and prior to enabling the player to place any additional wagers on any additional plays of any separate games, for each wagered on play of each of the plurality of separate games of each total wager placed:

(a) generate an outcome for said play of said game;

(b) display to the player the generated outcome for said play of said game;

(c) determine if at least one designated triggering event occurs based on the play of said game;

(d) if said designated triggering event occurs based on the play of said game, modify a paytable associated with a different one of said plurality of games distinctly wagered on by the player;

(e) determine an award based on said outcome generated for said play of the game and the paytable associated with said game, wherein if the paytable associated with said game is modified, the award for said play of the game is determined based on said modified paytable; and (f) display said determined awards to the player.

2. The gaming system of claim 1, wherein said designated triggering event is selected from the group consisting of:

(a) an occurrence of at least one predetermined symbol or set of symbols generated in association with the outcome of at least one of said plurality of games;

(b) an occurrence of at least one predetermined symbol or set of symbols on a designated payline;

(c) a winning game outcome;

(d) a losing game outcome;

(e) a game event which is independent of any symbols generated in association with the outcomes of said plurality of games; and (f) a random event.

3. The gaming system of claim 1, wherein the modification of the paytable includes a modification selected from the group consisting of:

(a) a change of one of the awards in the paytable;

(b) a change of a plurality of the awards in the paytable;

(c) a change of one of the winning outcomes in the paytable;

(d) a change of a plurality of the winning outcomes in the paytable;

(e) an addition of winning outcomes to the paytable;

(f) an addition of a plurality of winning outcomes to the paytable;

(g) an application of a modifier to at least one award in the paytable;

(h) an increase of the probability of at least one winning game outcome being generated; and (i) a modification of an award associated with a designated payline in the paytable.

4. The gaming system of claim 1, wherein the modification of the paytable is associated with how many of said plurality of games the designated triggering event occurs in.

5. The gaming system of claim 1, wherein the modification of the paytable is associated with how many times the designated triggering event occurs based on the plays of said plurality of games.

6. The gaming system of claim 1, wherein the modification of the paytable lasts for a period selected from the group consisting of:

(a) a designated amount of time;

(b) a round of play; and (c) a duration of a designated number of games.

7. The gaming system of claim 1, wherein said plurality of games include a same type of game.

8. The gaming system of claim 1, wherein said plurality of games include at least two different types of games.

9. The gaming system of claim 1, wherein the games are slot-type games.

10. The gaming system of claim 1, wherein the at least one display device and the at least one input device are supported by a housing.

11. The gaming system of claim 10, wherein the at least one processor is remote from the housing.

12. The gaming system of claim 1, wherein said designated triggering event is associated with a game component.

13. The gaming system of claim 12, wherein said game component is a payline.

14. The gaming system of claim 12, wherein the plurality of instructions, which when executed by the at least one processor, cause the at least one processor to operate with the at least one display device and the at least one input device to change an award associated with said game component in the paytable of the different one of the games.

15. A gaming system comprising:

at least one display device;

at least one input device;

at least one processor; and at least one memory device storing a plurality of instructions, which when executed by the at least one processor, cause the at least one processor to operate with the at least one display device and the at least one input device to:

(i) enable a player to place a total wager associated with a plurality of distinct wagers on a plurality of simultaneous plays of a plurality of separate games; and (ii) after receiving the total wager and prior to enabling the player to place any additional wagers on any additional plays of any separate games, for each wagered on play of each of the plurality of separate games of each total wager placed:

(a) generate an outcome for said play of said game;

(b) display to the player the generated outcome for said play of said game;

(c) determine if at least one designated triggering event occurs based on the play of said game;

(d) if said designated triggering event occurs based on the play of said game, activate an alternative paytable in place of a default paytable associated with a different one of the plurality of games distinctly wagered on by the player;

(e) determine an award based on said outcome generated for said play of the game and the paytable associated with said game, wherein if the alternative paytable associated with said game is activated, the award for said play of the game is determined based on said activated alternative paytable; and (f) display said determined awards to the player.

16. The gaming system of claim 15, wherein the alternative paytable is activated for a period selected from the group consisting of:

(a) a designated amount of time;

(b) a round of play; and (c) a designated number of games.

17. The gaming system of claim 15, wherein different designated triggering events are associated with different respective alternative paytables.

18. The gaming system of claim 16, wherein different designated triggering events are associated with different respective periods.

19. The gaming system of claim 15, wherein said designated triggering event is selected from the group consisting of:

(a) an occurrence of at least one predetermined symbol or set of symbols generated in association with the outcome of at least one of said plurality of games;

(b) an occurrence of at least one predetermined symbol or set of symbols on a designated payline;

(c) a winning game outcome;

(d) a losing game outcome;

(e) a game event which is independent of any symbols generated in association with the outcomes of said plurality of games; and (f) a random event.

20. The gaming system of claim 15, wherein said plurality of games include a same type of game.

21. The gaming system of claim 15, wherein said plurality of games include at least two different types of games.

22. The gaming system of claim 15, wherein the games are slot-type games.

23. The gaming system of claim 15, wherein the at least one display device and the at least one input device are supported by a housing.

24. The gaming system of claim 23, wherein the at least one processor is remote from the housing.

25. A method of operating a gaming system, said method including:

(i) enabling a player to place a total wager associated with a plurality of distinct wagers on a plurality of simultaneous plays of a plurality of separate games; and (ii) after receiving the total wager and prior to enabling the player to place any additional wagers on any additional plays of any separate games, for each wagered on play of each of the plurality of separate games of each total wager placed:

(a) causing at least one processor to execute a plurality of instructions to generate an outcome for said play of said game;

(b) causing at least one display device to display to the player the generated outcome for said play of said game;

(c) causing the at least one processor to execute the plurality of instructions to determine if at least one designated triggering event occurs based on the play of said game;

(d) if said designated triggering event occurs based on the play of said game, causing the at least one processor to execute the plurality of instructions to modify a paytable associated with a different one of said plurality of games distinctly wagered on by the player;

(e) causing the at least one processor to execute the plurality of instructions to determine an award based on said outcome generated for said play of the game and the paytable associated with said game, wherein if the paytable associated with said game is modified, the award for said play of the game is determined based on said modified paytable; and (f) causing the at least one display device to display said determined awards to the player.

26. The method of claim 25, wherein the designated triggering event is selected from the group consisting of:

(a) an occurrence of at least one predetermined symbol or set of symbols generated in association with the outcome of at least one of said plurality of games;

(b) an occurrence of at least one predetermined symbol or set of symbols on a designated payline;

(c) a winning game outcome;

(d) a losing game outcome;

(e) a game event which is independent of any symbols generated in association with the outcomes of said plurality of games; and (f) a random event.

27. The method of claim 25, which includes causing the at least one processor to execute the plurality of instructions to modify the paytable of another of said plurality of games based on at least one selected from the group consisting of:

(a) causing the at least one processor to execute the plurality of instructions to change one of the awards in the paytable;

(b) causing the at least one processor to execute the plurality of instructions to change a plurality of the awards in the paytable;

(c) causing the at least one processor to execute the plurality of instructions to change one of the winning outcomes in the paytable;

(d) causing the at least one processor to execute the plurality of instructions to change a plurality of the winning outcomes in the paytable;

(e) causing the at least one processor to execute the plurality of instructions to add winning outcomes to the paytable;

(f) causing the at least one processor to execute the plurality of instructions to add a plurality of winning outcomes to the paytable;

(g) causing the at least one processor to execute the plurality of instructions to apply a modifier to at least one award in the paytable;

(h) causing the at least one processor to execute the plurality of instructions to increase probability of at least one winning game outcome being generated; and (i) causing the at least one processor to execute the plurality of instructions to modify an award associated with a designated payline in the paytable.

28. The method of claim 25, wherein causing the at least one processor to execute the plurality of instructions to modify the paytable is associated with how many of said plurality of games the designated triggering event occurs in.

29. The method of claim 25, wherein causing the at least one processor to execute the plurality of instructions to modify the paytable is associated with how many times the designated triggering event occurs based on the plays of said plurality of games.

30. The method of claim 25, which includes causing the at least one processor to execute the plurality of instructions to modify the paytable for a period selected from the group consisting of:

(a) a designated amount of time;

(b) a round of play; and (c) a duration of a designated number of games.

31. The method of claim 25, wherein said plurality of games include a same type of game.

32. The method of claim 25, wherein said plurality of games include at least two different types of games.

33. The method of claim 25, wherein the games are slot-type games.

34. The method of claim 25, wherein said designated triggering event is associated with a game component.

35. The method of claim 34, wherein said game component is a payline.

36. The method of claim 34, which includes causing the at least one processor to execute the plurality of instructions to change an award associated with said game component in the paytable associated with the different one of the games.

37. The method of claim 25, which is provided through a data network.

38. The method of claim 37, wherein the data network is an internet.

39. A method of operating a gaming system, said method including:

(i) enabling a player to place a total wager associated with a plurality of distinct wagers on a plurality of simultaneous plays of a plurality of separate games; and (ii) after receiving the total wager and prior to enabling the player to place any additional wagers on any additional plays of any separate games, for each wagered on play of each of the plurality of separate games of each total wager placed:

(a) causing at least one processor to execute a plurality of instructions to generate an outcome for said play of said game;

(b) causing at least one display device to display to the player the generated outcome for said play of said game;

(c) causing the at least one processor to execute the plurality of instructions to determine if at least one designated triggering event occurs in based on the play of said game;

(d) if said designated triggering event occurs based on the play of said game, causing the at least one processor to execute the plurality of instructions to activate an alternative paytable in place of a default paytable associated with a different one of the plurality of games distinctly wagered on by the player;

(e) causing the at least one processor to execute the plurality of instructions to determine an award based on said outcome generated for said play of the game and the paytable associated with said game, wherein if the alternative paytable associated with said game is activated, the award for said play of the game is determined based on said activated alternative paytable; and (f) causing the at least one display device to display said determined awards to the player.

40. The method of claim 39, which includes causing the at least one processor to execute the plurality of instructions to activate the alternative paytable for a period selected from the group consisting of:

(a) a designated amount of time;

(b) a round of play; and (c) a designated number of games.

41. The method of claim 39, wherein different designated triggering events are associated with different respective alternative paytables.

42. The method of claim 40, wherein different designated triggering events are associated with different respective periods.

43. The method of claim 39, wherein the designated triggering event is selected from the group consisting of:

(a) an occurrence of at least one predetermined symbol or set of symbols generated in association with the outcome of at least one of said plurality of games;

(b) an occurrence of at least one predetermined symbol or set of symbols on a designated payline;

(c) a winning game outcome;

(d) a losing game outcome;

(e) a game event which is independent of any symbols generated in association with the outcomes of said plurality of games; and (f) a random event.

44. The method of claim 39, wherein said plurality of games include a same type of game.

45. The method of claim 39, wherein said plurality of games include at least two different types of games.

46. The method of claim 39, wherein the games are slot-type games.

47. The method of claim 39, which is provided through a data network.

48. The method of claim 47, wherein the data network is an internet.

* * * * *